US011905700B2

(12) United States Patent
Stahl et al.

(10) Patent No.: US 11,905,700 B2
(45) **Date of Patent: *Feb. 20, 2024**

(54) SLIDE CLIP

(71) Applicant: Clarkwestern Dietrich Building Systems LLC, West Chester, OH (US)

(72) Inventors: Gregg Allan Stahl, Lebanon, OH (US); Brett Daniel Hironimus, Beaver Falls, PA (US)

(73) Assignee: Clarkwestern Dietrich Building Systems LLC, West Chester, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/199,417

(22) Filed: May 19, 2023

(65) Prior Publication Data

US 2023/0287675 A1 Sep. 14, 2023

Related U.S. Application Data

(63) Continuation of application No. 17/381,436, filed on Jul. 21, 2021, now Pat. No. 11,692,340.

(60) Provisional application No. 63/054,970, filed on Jul. 22, 2020.

(51) Int. Cl.
*E04B 1/24* (2006.01)
*E04B 1/38* (2006.01)

(52) U.S. Cl.
CPC ..... *E04B 1/2403* (2013.01); *E04B 1/388* (2023.08); *E04B 2001/2415* (2013.01); *E04B 2001/2439* (2013.01)

(58) Field of Classification Search
CPC .. E04B 1/2403; E04B 1/40; E04B 2001/2415; E04B 2001/2439
See application file for complete search history.

(56) References Cited

U.S. PATENT DOCUMENTS

| | | | |
|---|---|---|---|
| 1,188,959 | A | 6/1916 | McAlarney |
| 1,400,007 | A | 12/1921 | Sparks |
| 1,486,509 | A | 3/1924 | Whittaker |
| 1,600,794 | A | 9/1926 | Brown |
| 2,058,386 | A | 10/1936 | Parsons |

(Continued)

FOREIGN PATENT DOCUMENTS

| | | | |
|---|---|---|---|
| CA | 2165643 | A1 | 6/1996 |
| CA | 2243897 | A1 | 2/1999 |

(Continued)

OTHER PUBLICATIONS

Clamp L Shape Bracket, MiSumi, USA, 2012 Metric Catalog, p. 1-1552, downloaded from https://us.misumi-ec.com/pdf/fa/2012/p1_1551.pdf, 1 pg.

(Continued)

*Primary Examiner* — Rodney Mintz
(74) *Attorney, Agent, or Firm* — Frost Brown Todd LLP

(57) ABSTRACT

A slide clip includes a first plate and a second plate coupled at a juncture. The first plate and the second plate form an angle at the juncture. The second plate has a first elongated slot, a second elongated slot, and a third elongated slot, each extending parallel with the juncture. The first elongated slot and the second elongated slot are each offset from the juncture a first distance. The third elongated slot is offset from the juncture a second distance that is greater than the first distance.

18 Claims, 12 Drawing Sheets

(56) References Cited

U.S. PATENT DOCUMENTS

| | | | |
|---|---|---|---|
| 2,106,084 | A | 1/1938 | Coddington |
| 2,235,761 | A | 3/1941 | Goldsmith |
| 2,258,574 | A | 10/1941 | Leary |
| 2,365,478 | A | 12/1944 | La Grotta |
| 3,003,600 | A | 10/1961 | Mackenzie |
| 3,113,358 | A | 12/1963 | Zell |
| 3,350,830 | A | 11/1967 | Smith et al. |
| 3,353,312 | A | 11/1967 | Storch |
| 3,445,977 | A | 5/1969 | Latiano |
| 3,490,797 | A | 1/1970 | Platte |
| 3,753,325 | A | 8/1973 | Stanley |
| 3,798,865 | A | 3/1974 | Curtis |
| 3,940,900 | A | 3/1976 | Russo |
| 4,022,415 | A | 5/1977 | Roderick |
| 4,035,093 | A | 7/1977 | Redshaw |
| 4,060,905 | A | 12/1977 | Light |
| 4,097,012 | A | 6/1978 | McIntyre |
| 4,131,221 | A | 12/1978 | Yeager |
| 4,194,333 | A | 3/1980 | Paton |
| 4,251,969 | A | 2/1981 | Bains |
| 4,263,764 | A | 4/1981 | Wendt |
| 4,321,776 | A | 3/1982 | Delight |
| 4,363,459 | A | 12/1982 | Holzer |
| 4,409,765 | A | 10/1983 | Pall |
| D272,719 | S | 2/1984 | Skjaeveland |
| 4,433,524 | A | 2/1984 | Matson |
| 4,464,074 | A | 8/1984 | Green et al. |
| 4,709,517 | A | 12/1987 | Mitchell |
| 4,723,747 | A | 2/1988 | Karp et al. |
| 4,765,108 | A | 8/1988 | Lapish |
| 4,796,403 | A | 1/1989 | Fulton |
| 4,815,734 | A | 3/1989 | Verhulst |
| 4,835,935 | A | 6/1989 | Murphy |
| 4,899,510 | A | 2/1990 | Propst |
| 4,918,893 | A | 4/1990 | Vandenbroucke et al. |
| 4,932,173 | A | 6/1990 | Commins |
| 4,949,929 | A | 8/1990 | Kesselman et al. |
| D310,478 | S | 9/1990 | Lang |
| 4,955,172 | A | 9/1990 | Pierson |
| D312,962 | S | 12/1990 | Overton |
| 5,004,369 | A | 4/1991 | Young |
| 5,009,557 | A | 4/1991 | Dessirier |
| 5,027,494 | A | 7/1991 | Martin |
| 5,040,345 | A | 8/1991 | Gilmour |
| 5,090,171 | A | 2/1992 | Kano |
| 5,118,060 | A | 6/1992 | Spronken |
| 5,152,117 | A | 10/1992 | Wynar |
| 5,169,062 | A | 12/1992 | Baker |
| 5,201,787 | A | 4/1993 | LaLonde et al. |
| 5,216,858 | A | 6/1993 | Gilmour |
| 5,217,317 | A | 6/1993 | Young |
| D339,735 | S | 9/1993 | Brennan |
| 5,271,586 | A | 12/1993 | Schmidt |
| 5,313,752 | A | 5/1994 | Hatzinikolas |
| 5,375,382 | A | 12/1994 | Weidlinger |
| 5,392,579 | A | 2/1995 | Champagne |
| 5,392,581 | A | 2/1995 | Hatzinikolas |
| 5,408,724 | A | 4/1995 | Mullet |
| D360,571 | S | 7/1995 | Perry |
| 5,454,203 | A | 10/1995 | Turner |
| 5,457,928 | A | 10/1995 | Sahnazarian |
| 5,467,566 | A | 11/1995 | Swartz et al. |
| 5,529,273 | A | 6/1996 | Benthin |
| D371,506 | S | 7/1996 | Nofziger |
| D373,902 | S | 9/1996 | Wang |
| 5,554,392 | A | 9/1996 | Gray |
| D375,038 | S | 10/1996 | Trevorrow |
| 5,572,844 | A | 11/1996 | Stackenwalt et al. |
| 5,611,179 | A | 3/1997 | Leek |
| 5,640,823 | A | 6/1997 | Bergeron et al. |
| 5,664,392 | A | 9/1997 | Mucha |
| 5,664,754 | A | 9/1997 | Gaenslen |
| 5,671,580 | A | 9/1997 | Chou |
| 5,678,797 | A | 10/1997 | Gogan |
| 5,685,121 | A | 11/1997 | DeFrancesco |
| 5,718,533 | A | 2/1998 | Mullet |
| 5,720,571 | A | 2/1998 | Frobosilo et al. |
| 5,743,063 | A | 4/1998 | Boozer |
| 5,779,206 | A | 7/1998 | Harris |
| D398,820 | S | 9/1998 | Cougar |
| 5,810,303 | A | 9/1998 | Bourassa et al. |
| D400,081 | S | 10/1998 | Ibaragi |
| 5,836,133 | A | 11/1998 | Bergeron et al. |
| 5,846,018 | A | 12/1998 | Frobosilo et al. |
| 5,857,306 | A | 1/1999 | Pellock |
| 5,876,006 | A | 3/1999 | Sharp et al. |
| D408,266 | S | 4/1999 | Santiago |
| 5,904,023 | A | 5/1999 | diGirolamo et al. |
| 5,906,080 | A | 5/1999 | diGirolamo et al. |
| 5,924,259 | A | 7/1999 | Marousek |
| 5,937,605 | A | 8/1999 | Wendt |
| D414,398 | S | 9/1999 | Benz et al. |
| 5,956,916 | A | 9/1999 | Liss |
| 6,009,681 | A | 1/2000 | Kozloff |
| D420,565 | S | 2/2000 | Griffiths |
| 6,018,923 | A | 2/2000 | Wendt |
| D422,886 | S | 4/2000 | Shea |
| 6,058,668 | A | 5/2000 | Herren |
| 6,088,982 | A | 7/2000 | Hiesberger |
| D432,901 | S | 10/2000 | McDonald |
| 6,138,425 | A | 10/2000 | Wendt |
| 6,199,929 | B1 | 3/2001 | Hansch |
| 6,213,679 | B1 | 4/2001 | Frobosilo et al. |
| D442,471 | S | 5/2001 | Willett |
| 6,250,041 | B1 | 6/2001 | Seccombe |
| D451,786 | S | 12/2001 | Wyatt |
| 6,427,416 | B1 | 8/2002 | Rassel |
| 6,508,447 | B1 | 1/2003 | Catani et al. |
| 6,523,322 | B1 | 2/2003 | Michalski et al. |
| 6,585,448 | B2 | 7/2003 | Grossman |
| 6,609,344 | B2 | 8/2003 | Saldana |
| 6,612,087 | B2 | 9/2003 | diGirolamo et al. |
| D482,261 | S | 11/2003 | Kobayashi |
| D482,598 | S | 11/2003 | Brass |
| 6,688,069 | B2 | 2/2004 | Zadeh |
| 6,741,703 | B1 | 5/2004 | Clour |
| 6,792,733 | B2 | 9/2004 | Wheeler et al. |
| 6,871,470 | B1 | 3/2005 | Stover |
| D517,402 | S | 3/2006 | Cairns |
| 7,021,021 | B2 | 4/2006 | Saldana |
| 7,065,932 | B2 | 6/2006 | Roesset et al. |
| D527,986 | S | 9/2006 | Johnson |
| 7,104,024 | B1 | 9/2006 | di Girolamo et al. |
| D530,191 | S | 10/2006 | Taylor |
| 7,127,862 | B2 | 10/2006 | Saldana |
| D532,290 | S | 11/2006 | David |
| D533,445 | S | 12/2006 | Janzen |
| D536,954 | S | 2/2007 | Sjoeberg |
| 7,174,690 | B2 | 2/2007 | Zadeh |
| 7,178,304 | B2 | 2/2007 | Brady |
| D543,834 | S | 6/2007 | Worthy |
| 7,293,393 | B2 | 11/2007 | Kelly et al. |
| 7,299,593 | B1 | 11/2007 | diGirolamo et al. |
| 7,356,973 | B2 | 4/2008 | Roesset et al. |
| D569,232 | S | 5/2008 | Yoshida |
| D572,114 | S | 7/2008 | Segovia |
| D576,473 | S | 9/2008 | Cresswell |
| 7,478,508 | B2 | 1/2009 | Peterson |
| D587,100 | S | 2/2009 | Allsopp |
| 7,503,150 | B1 | 3/2009 | di Girolamo et al. |
| 7,533,508 | B1 | 5/2009 | diGirolamo et al. |
| D595,114 | S | 6/2009 | Hamilton |
| 7,614,195 | B2 | 11/2009 | Platt et al. |
| D608,183 | S | 1/2010 | Meyer |
| 7,658,356 | B1 | 2/2010 | Nehls |
| D621,692 | S | 8/2010 | Clarke |
| D628,539 | S | 12/2010 | Tezak et al. |
| D630,346 | S | 1/2011 | Horta |
| 7,902,457 | B2 | 3/2011 | Johnson |
| 7,918,054 | B2 | 4/2011 | Grafton et al. |
| D638,286 | S | 5/2011 | Tedesco et al. |
| D640,916 | S | 7/2011 | Sias |
| D644,503 | S | 9/2011 | Crane |
| D649,016 | S | 11/2011 | Rasmussen |

(56) References Cited

U.S. PATENT DOCUMENTS

| | | | |
|---|---|---|---|
| D652,951 | S | 1/2012 | Crane et al. |
| 8,091,316 | B2 | 1/2012 | Beck et al. |
| 8,181,419 | B1 | 5/2012 | diGirolamo |
| D663,020 | S | 7/2012 | Purnell |
| D663,190 | S | 7/2012 | Mota et al. |
| 8,234,826 | B1 | 8/2012 | Proffitt, Jr. |
| 8,240,103 | B2 | 8/2012 | Riepe |
| D667,288 | S | 9/2012 | Preda |
| D667,289 | S | 9/2012 | Preda |
| 8,272,806 | B2 | 9/2012 | Mogar et al. |
| 8,281,541 | B2 | 10/2012 | Lucey et al. |
| 8,347,581 | B2 | 1/2013 | Doerr et al. |
| 8,387,321 | B2 | 3/2013 | diGirolamo et al. |
| D684,033 | S | 6/2013 | Preda |
| 8,453,407 | B2 | 6/2013 | Tedesco et al. |
| 8,511,032 | B2 | 8/2013 | Abdel-Rahman et al. |
| 8,544,229 | B2 | 10/2013 | Kilgore et al. |
| 8,555,592 | B2 | 10/2013 | Daudet et al. |
| D692,746 | S | 11/2013 | Lawson et al. |
| 8,590,257 | B2 | 11/2013 | Yurko, Sr. |
| 8,615,942 | B2 | 12/2013 | LaFreniere |
| 8,615,948 | B2 | 12/2013 | Underkofler et al. |
| 8,683,770 | B2 | 4/2014 | diGirolamo et al. |
| 8,713,872 | B2 | 5/2014 | Rempel |
| 8,763,336 | B2 | 7/2014 | Gulbrandsen et al. |
| 8,769,887 | B2 | 7/2014 | Proffitt, Jr. |
| 8,800,232 | B1 | 8/2014 | Keenan |
| 8,813,457 | B2 | 8/2014 | Underkofler et al. |
| 8,833,008 | B2 | 9/2014 | Truckner |
| 8,950,151 | B2 | 2/2015 | Strickland et al. |
| 8,973,333 | B2 | 3/2015 | Sugihara et al. |
| 8,998,137 | B2 | 4/2015 | Braeutigam et al. |
| 9,010,070 | B2 | 4/2015 | Darr, III et al. |
| D729,611 | S | 5/2015 | Schmidt |
| D730,545 | S | 5/2015 | Stauffer et al. |
| 9,032,681 | B1 | 5/2015 | Brady |
| D731,876 | S | 6/2015 | Di Stefano |
| D732,708 | S | 6/2015 | Stauffer et al. |
| 9,045,892 | B2 | 6/2015 | Smith et al. |
| 9,091,056 | B2 | 7/2015 | Stauffer et al. |
| 9,140,000 | B1 | 9/2015 | Brady |
| D740,108 | S | 10/2015 | Di Stefano |
| 9,234,344 | B2 | 1/2016 | Hatzinikolas |
| 9,255,403 | B1 | 2/2016 | Lehane et al. |
| D751,222 | S | 3/2016 | Darr, III et al. |
| D751,733 | S | 3/2016 | Darr, III et al. |
| 9,290,928 | B2 | 3/2016 | Klein |
| D753,638 | S | 4/2016 | Tatem et al. |
| D766,701 | S | 9/2016 | Snell |
| D769,698 | S | 10/2016 | Oltrogge |
| D774,874 | S | 12/2016 | Wentzel et al. |
| 9,663,948 | B2 | 5/2017 | Lehane et al. |
| 9,677,269 | B2 | 6/2017 | Wright |
| D810,546 | S | 2/2018 | Shaw et al. |
| 9,896,840 | B2 | 2/2018 | Ting |
| 9,909,312 | B2 | 3/2018 | Lehane et al. |
| D814,905 | S | 4/2018 | Ralph et al. |
| D815,313 | S | 4/2018 | Ralph et al. |
| D815,314 | S | 4/2018 | Ralph et al. |
| D815,315 | S | 4/2018 | Ralph et al. |
| D815,316 | S | 4/2018 | Ralph et al. |
| D817,149 | S | 5/2018 | Ralph et al. |
| 10,024,048 | B2 | 7/2018 | Getz |
| 10,087,617 | B2 | 10/2018 | Daudet et al. |
| 10,132,341 | B2 | 11/2018 | di Girolamo et al. |
| 10,273,679 | B2 | 4/2019 | Daudet et al. |
| 10,323,414 | B2 | 6/2019 | Haba et al. |
| 10,724,229 | B2 | 7/2020 | Daudet |
| D906,788 | S | 1/2021 | Ochi |
| 10,961,704 | B2 | 3/2021 | Daudet |
| 11,078,682 | B1 | 8/2021 | diGirolamo |
| D931,496 | S | 9/2021 | Melin |
| D943,404 | S | 2/2022 | Tran et al. |
| D959,250 | S | 8/2022 | Stahl et al. |
| D959,251 | S | 8/2022 | Stahl et al. |
| 11,692,340 | B2 * | 7/2023 | Stahl ..... E04B 1/2403 52/506.01 |
| 2002/0023405 | A1 | 2/2002 | Zadeh |
| 2002/0062617 | A1 | 5/2002 | di Girolamo et al. |
| 2005/0279901 | A1 | 12/2005 | McCoy et al. |
| 2006/0026924 | A1 | 2/2006 | Madsen |
| 2006/0032183 | A1 | 2/2006 | Peterson |
| 2006/0096192 | A1 | 5/2006 | Daudet |
| 2007/0089841 | A1 | 4/2007 | Rossato et al. |
| 2008/0053034 | A1 | 3/2008 | Matechuk et al. |
| 2008/0163581 | A1 | 7/2008 | Greth |
| 2008/0258026 | A1 | 10/2008 | Smith et al. |
| 2009/0113827 | A1 | 5/2009 | Stone et al. |
| 2009/0193750 | A1 | 8/2009 | Klima |
| 2010/0083606 | A1 | 4/2010 | Davis et al. |
| 2010/0126103 | A1 | 5/2010 | diGirolamo et al. |
| 2011/0197541 | A1 | 8/2011 | Knoop |
| 2011/0219720 | A1 | 9/2011 | Strickland et al. |
| 2012/0247059 | A1 | 10/2012 | Daudet et al. |
| 2013/0125400 | A1 | 5/2013 | Clapp et al. |
| 2013/0139466 | A1 | 6/2013 | Abdel-Rahman et al. |
| 2014/0290175 | A1 | 10/2014 | Klein |
| 2014/0352249 | A1 | 12/2014 | Jankovec et al. |
| 2015/0159369 | A1 | 6/2015 | Chen et al. |
| 2015/0308098 | A1 | 10/2015 | Tessadori |
| 2016/0333579 | A1 | 11/2016 | Stein |
| 2017/0044787 | A1 | 2/2017 | di Girolamo et al. |
| 2017/0204599 | A1 | 7/2017 | Daudet et al. |
| 2017/0204600 | A1 | 7/2017 | Daudet et al. |
| 2018/0066424 | A1 | 3/2018 | Daudet |
| 2018/0066425 | A1 | 3/2018 | Ralph et al. |
| 2018/0135293 | A1 | 5/2018 | Daudet |
| 2018/0148920 | A1 | 5/2018 | Delfeld |
| 2018/0266101 | A1 * | 9/2018 | Haba ..... F16B 7/0453 |
| 2022/0025637 | A1 * | 1/2022 | Stahl ..... E04B 1/2403 |

FOREIGN PATENT DOCUMENTS

| | | | |
|---|---|---|---|
| CA | 2217076 | A1 | 4/1999 |
| CA | 2260554 | A1 | 7/1999 |
| CA | 2742742 | A1 | 3/2010 |
| CA | 2463747 | C | 1/2011 |
| CA | 2830677 | A1 | 10/2012 |
| CA | 2940128 | A1 | 10/2012 |
| CA | 2934777 | A1 | 7/2015 |
| CA | 2838361 | C | 4/2016 |
| CA | 162955 | S | 5/2016 |
| CA | 2784885 | C | 4/2017 |
| CN | 303539282 | | 1/2016 |
| EP | 1 070 904 | B1 | 2/2005 |
| EP | 2 093 335 | A2 | 8/2009 |
| EP | 2 093 336 | A2 | 8/2009 |
| EP | 1 770 840 | B1 | 11/2009 |
| JP | D 1330583 | | 5/2008 |
| WO | WO 00/07483 | A1 | 2/2000 |
| WO | WO 2007/115351 | A1 | 10/2007 |
| WO | WO 2010/009727 | A1 | 1/2010 |
| WO | WO 2010/092563 | A1 | 8/2010 |
| WO | WO 2014/004363 | A1 | 1/2014 |
| WO | WO 2014/193486 | A1 | 12/2014 |
| WO | WO 2015/003216 | A1 | 1/2015 |
| WO | WO 2015/101582 | A2 | 7/2015 |
| WO | WO 2016/028500 | A1 | 2/2016 |

OTHER PUBLICATIONS

ClarkDietrick Drift FastClip Slide Clip, downloaded from https://www.youtube.com/watch?v=c0v0p1odJQ8, posted Feb. 3, 2017, 1 pg.

ClarkDietrich FastClip, YouTube https://www.youtube.com/watch?v=XLbGZBs6Mwc Mar. 28, 2014 (Year: 2014), 1 pg.

ClarkDietrich FastClip Slide Clip 14 Gauge 5-1/2" × 1-1/2" × 4-1/2" (INC. 80 Screws) FCSC5.5-68 (25/Box) • Benefast, https://benefast.com/product/clarkdietrich-fastclip-slide-clip-14-gauge-5-1-2-x-1-1-2-x-4-1-2-inc-80-screws-fcsc5-5-68-25-box/, Sep. 2020 (Year: 2020), 3 pgs.

(56) References Cited

OTHER PUBLICATIONS

Curtainwall Deflection Solutions, Super Stud Building Products, Inc., Brochure, 2001, 24 pgs.
Curtain Wall Brochure, The Steel Network, publication date unknown, Raleigh, North Carolina, 12 pgs.
DESC—Exterior Head-of-Wall Drift Clip, SCAFCO Steel Stud Company, Jun. 26, 2016, downloaded from http://www.scafco.com/steel/products/deflection-clips/desc-exterior-head-of-wall-multi-drift-clip, 2 pgs.
DISC—Interior Head-of-Wall Drift Clip, SCAFCO Steel Stud Company, Jun. 26, 2016, downloaded from http://scafco.com/steel/products/deflection-clips/disc-interior-head-of-wall-multi-drift-clip, 2pgs.
Double Bypass & Triple Bypass—Curtain Vertical Deflection Clips, SSDB & SSTB Series, Product Submittal Sheet, Super Stud Building Products, Inc., 2019, downloaded Oct. 27, 2020 from https://www.buysuperstud.com/PDF/pdf/SuperStud%20Triple%20Bypass%20Vertical%20Deflection%20Clips%20(SSTB).pdf, 2 pgs.
DPLC2—Bypass Slab Drift Clip, SCAFCO Steel Stud Company, Jun. 16, 2016, downloaded from http://www.scafco.com/steel/products/deflection-clips/dplc2-bypass-slab-drift-strut, 2 pgs.
DPLC2—Bypass Slab Drift Clip, SCAFCO Steel Stud Company, 2000, downloaded Oct. 27, 2020 from https://www.scafco.com/steel/products/deflection-clips/dplc2-bypass-slab-drift-clip/, 4 pgs.
Drift FastClip™ M Slide Clip (D-FCSC), Product Submittal Sheets, ClarkDietrich Building Systems, Sep. 2020, downloaded Oct. 23, 2020 from https://www.clarkdietrich.com/products/drift-connections/drift-fastclip-slide-clip-d-fcsc#submittals, 6 pgs.
Drift Head-Of-Wall (DHOW), Product Submittal Sheets, ClarkDietrich Building Systems, Feb. 2019, downloaded Oct. 23, 2020 from https://www.clarkdietrich.com/products/drift-connections/drift-head-wall-dhow#submittals, 6 pgs.
Drift Rail (DR97) and Clip (DRC), Product Submittal Sheets, ClarkDietrich Building Systems, Sep. 2020, downloaded Oct. 23, 2020 from https://www.clarkdietrich.com/products/drift-connections/drift-rail-dr97-and-clip-drc#submittals, 6 pgs.
Drift-Clip Bypass Framing Connector, Tech Sheet, Simpson Strong-Tie Company, Inc., May 2016, 2 pgs.
DriftClip® DSLB, Bypass Slab, Tech Sheet, The Steel Network, Inc., Jul. 2017, downloaded Oct. 27, 2020 from https://steelnetwork.com/Product/DriftClipDSLB, 2 pgs.
DriftTrak® DTSL, Tech Sheet, The Steel Network, Inc. (TSN), 2012, downloaded Jul. 6, 2017 from https://web.archive.org/web/20121008023139/http://www.steelnetwork.com/product/drift-trakdts1, 2 pg.
DriftTrak® DTSL, The Steel Network, downloaded from https://www.steelnetwork.com/Product/DriftTrakDTSL, available Apr. 1, 2016, 2 pgs.
DriftTrak® DTSLB, Tech Sheet, The Steel Network, Inc. (TSN), 2012, downloaded Jul. 6, 2017 from https://web.archive.org/web/20121008022926/http://www.steelnetwork.com/product/drift-trakdtslb, 3 pgs.
DSSCB Bypass Framing Drift Strut Connector, Simpson Strong-Tie, 2020, downloaded Oct. 4, 2021 from https://www.strongtie.com/driftconnectors_coldformedsteelconstruction/dsscb_clip/p/dsscb#ProductDetails, 8 pgs.
DWSC Slide Clips, FrameRite Connectors, Marino Ware, Jun. 16, 2016, downloaded from http://www.marinoware.com/Products/frameriteConn.asp?prod=5, 1 pg.
Extended FastClip™ (FCEC), Product Submittal Sheets, ClarkDietrich Building Systems, Oct. 2018, downloaded Oct. 23, 2020 from https://www.clarkdietrich.com/products/curtain-wall-bypass-connections/extended-fastclip-fcec#submittals, 5 pgs.
Fast Strut™ (FS12, FS15, FS18, FS20, FS22, FS24), Product Submittal Sheets, ClarkDietrich Building Systems, Sep. 2020, downloaded Oct. 23, 2020 from https://www.clarkdietrich.com/products/curtain-wall-bypass-connections/fast-strut-fs12-fs15-fs18-fs20-fs22-fs24#submittals, 6 pgs.
Fast Top™ Clip (FTC), Product Submittal Sheets, ClarkDietrich Building Systems, Sep. 2020, downloaded Oct. 23, 2020 from https://www.clarkdietrich.com/products/head-wall-deflection-connections/fast-top-clip-ftc#submittals, 5 pgs.
FastClip™ Slide Clip (FCSC-HD) w/Anchor Holes, Product Submittal Sheet, ClarkDietrich Building Systems, Sep. 2020, downloaded Oct. 23, 2020 from https://www.clarkdietrich.com/products/curtain-wall-bypass-connections/fastclip-slide-clip-fcsc-hd-w-anchor-holes#submittals , 1 pg.
FastClip™ Slide Clips (FCSC), Product Submittal Sheets, ClarkDietrich Building Systems, Jan. 2020, downloaded Oct. 23, 2020 from https://www.clarkdietrich.com/products/curtain-wall-bypass-connections/fastclip-slide-clips-fcsc#submittals, 3 pgs.
Flat Tail™ Slide Clip (FTSC), Product Submittal Sheets, ClarkDietrich Building Systems, Sep. 2020, downloaded Oct. 23, 2020 from https://www.clarkdietrich.com/products/curtain-wall-bypass-connections/flat-tail-slide-clip-ftsc#submittals, 4 pgs.
IDCB Drift-Clip Bypass Framing Connector, Catalog pages, Simpson Strong-Tie, 2000, downloaded Oct. 27, 2020 from https://www.strongtie.com/driftconnectors_coldformedsteelconstruction/idcb_clip/p/idcb, 1 pg.
MasterClip® VLB, Bypass Slab, Tech Sheet, The Steel Network, Inc., May 2019, downloaded Oct. 27, 2020 from https://steelnetwork.com/Product/MasterClipVLB, 2 pgs.
PLC2—Bypass Slab Slide Clip, SCAFCO Steel Stud Company, 2000, downloaded Oct. 27, 2020 from https://www.scafco.com/steel/products/deflection-clips/plc2-bypass-slab-slide-clip/, 3 pgs.
PLC4—Bypass Slab Slide Clip, SCAFCO Steel Stud Company, Jun. 7, 2017, downloaded from http://www.scafco.com/steel/products/deflection-clips/plc4-bypass-slide-clip, 2 pgs.
SC Bypass Framing Slide-Clip Connector, Catalog pages, Simpson Strong-Tie, 2000, downloaded Oct. 27, 2020 from https://www.strongtie.com/deflectionconnectors_coldformedsteelconstruction/sc_sclip/p/sc, 4 pgs.
SCB/MSCB Bypass Framing Slide-Clip Connectors, Catalog pages, Simpson Strong-Tie, 2000, downloaded Oct. 27, 2020 from https://www.strongtie.com/deflectionconnectors_coldformedsteelconstruction/scb_clip/p/scb.mscb, 3 pgs.
SCHA Slide-Clip Connectors for Horizontal Anchorage, Tech Sheet, Simpson Strong-Tie Company, Inc., Jan. 2016, 4 pgs.
SCS Seismic Bypass Framing Connector, Catalog pages, Simpson Strong-Tie, 2000, downloaded Oct. 27, 2020 from https://www.strongtie.com/deflectionconnectors_coldformedsteelconstruction/scs_clip/p/scs, 6 pgs.
SCW Head-of-Wall Slide-Clip Connectors, Submittal/Substitution Technical Information, Simpson Strong-Tie Company, Inc., Aug. 2016, 1 pg.
Simpson Strong-Tie SCW5.5-KT 5.5" Head-of-Wall Slide-Clip Connector Kit 25 pk, Nov. 19, 2016, downloaded from http://www.fastoolnow.com/scw5-5-kt.html, 3 pgs.
SmartFrame® VertiFlex™ SFVF, CRACO Mfg, SmartFrame® Connector System Product Catalog, Jan. 2020, p. 6, downloaded Oct. 27, 2020 from https://cracometals.com/wp-content/uploads/2020/06/SmartFrame-Connectors-Catalog-2020.pdf, 3 pgs.
Universal ByPass Clips (UBS), Product Submittal Sheets, ClarkDietrich Building Systems, Sep. 2020, downloaded Oct. 23, 2020 from https://www.clarkdietrich.com/products/curtain-wall-bypass-connections/universal-bypass-clips-ubc#submittals, 8 pgs.
VertiClip® SLB, Bypass Slab, Tech Sheet, The Steel Network, Inc., Oct. 2019, downloaded Oct. 27, 2020 from https://steelnetwork.com/Product/VertiClipSLB, 2 pgs.
VertiClip® SLB-HD, Bypass Slab for Seismic Conditions, Tech Sheet, The Steel Network, Inc., Dec. 2017, downloaded Oct. 27, 2020 from https://steelnetwork.com/Product/VertiClipSLB-HD, 1 pg.
VertiClip® SLD Metal Stud Connector for Light Gauge Steel Vertical Deflection, CAP Industries, Drywall trims, Nov. 22, 2016, downloaded from http://www.drywalltrims.com/product/VertiClip-SLD.html, 3 pgs.
VertiClip® SLD, Interior Head of Wall, The Steel Network, Inc., Tech Sheet, Catalog pp. 11-12, 2016, downloaded from https://www.steelnetwork.com/Product/VertiClipSLD, 2 pgs.

(56) References Cited

OTHER PUBLICATIONS

WSC Slide Clips, Marino WARE, 2000, downloaded Oct. 27, 2020 from https://www.marinoware.com/product/wsc-slide-clips/, 2 pgs.

* cited by examiner

SLIDE CLIP

PRIORITY

This application is a continuation of U.S. patent application Ser. No. 17/381,436, entitled "Slide Clip," filed Jul. 21, 2021, which claims priority to U.S. Provisional Pat. App. No. 63/054,970, entitled "Slide Clip," filed on Jul. 22, 2020, the disclosures of which are incorporated by reference herein in their entirety.

BACKGROUND

A building may be subject to a variety of different forces, such as wind, seismic and loading forces, that impact the building in various directions. Adjacent building components can be connected to each other using a clip or connector. In conventional construction, those building components have typically been connected in a rigid fashion. However, in some buildings, adjacent components have been connected using clips that allow the components to move horizontally and/or vertically relative to each other in an attempt to help the building withstand the variety of forces it is subject to over time.

While a variety of clips and connectors have been made and used, it is believed that no one prior to the inventors have made or used a slide clip as described herein.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
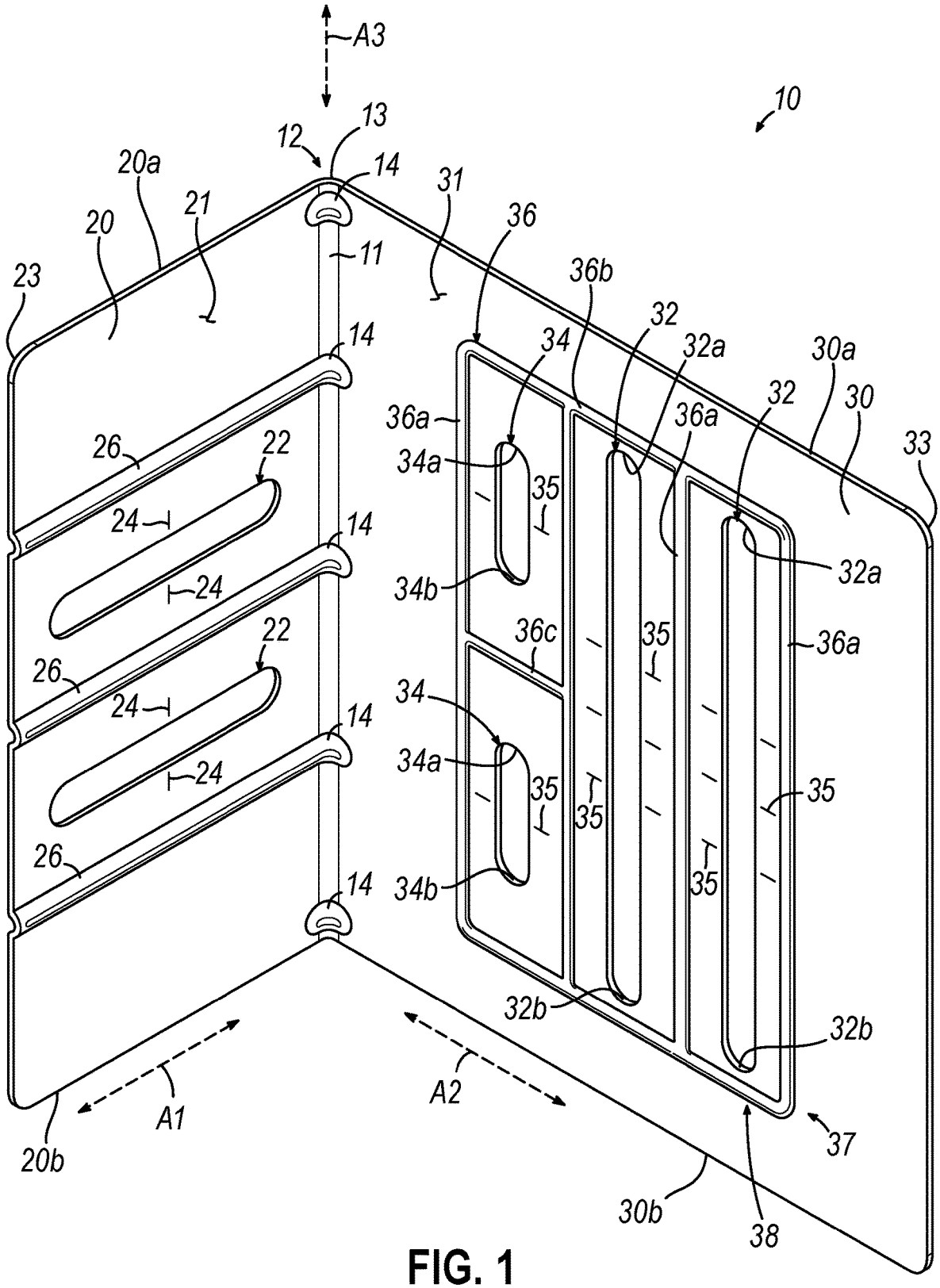
FIG. 1 depicts a perspective view of an exemplary slide clip.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that any one or more of the teachings, expressions, embodiments, versions, examples, etc. described herein may be combined with any one or more of the other teachings, expressions, embodiments, versions, examples, etc. that are described herein. The following-described teachings, expressions, embodiments, versions, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

As mentioned above, adjacent building components may be connected to each other using a clip or connector. For instance, a clip or connector may be utilized to connect a supporting assembly (such as a horizontally extending load bearing I-beam) with a supported assembly (such as a vertically extending stud). In instances where a clip is used to help support a vertically extending stud, such a stud may be further used as a support for an exterior wall, such as a curtain wall framing. Therefore, in such instances, the exterior wall may be structurally supported by the rest of the building structure via the stud, the clip, and the load bearing I-beam.

It may be desirable to have a clip that may suitably transmit loads from a supported assembly (such as the stud and exterior wall) to a supporting assembly (such as a load bearing I-beam) while maintaining a suitable connection between the supported assembly and the supporting assembly.

I. Slide Clip Allowing Vertical and Horizontal Movement

Figure 2:
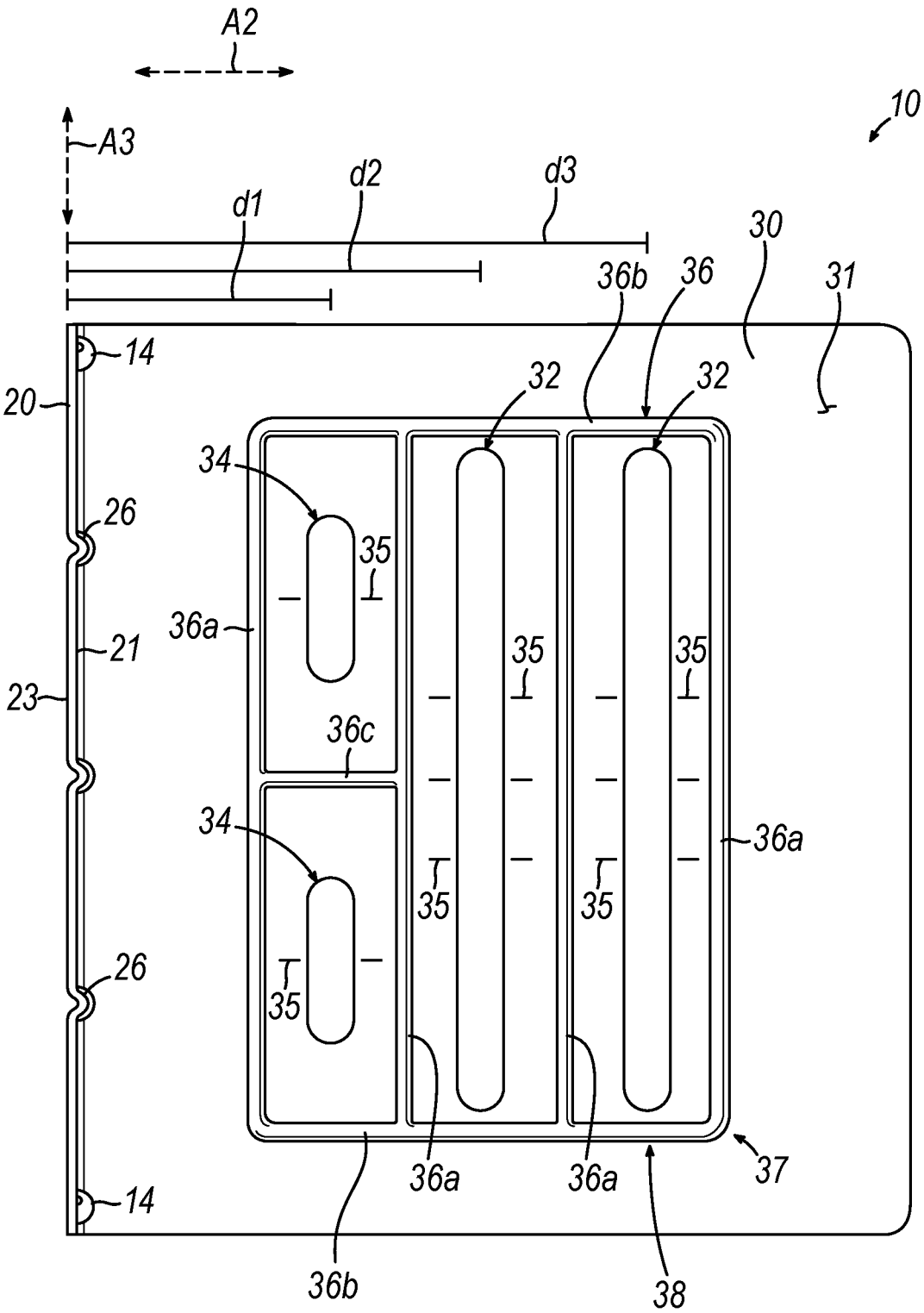
FIG. 2 depicts a front elevational view of the slide clip of FIG. 1.

FIGS. 1-2 illustrate one embodiment of a slide clip (10) configured to allow for both vertical and horizontal movement between adjacent building components connected by slide clip (10). In this embodiment, slide clip (10) includes a first plate (20) and a second plate (30). First plate (20) and second plate (30) can be formed from a single piece of material so that first plate (20) and second plate (30) are of unitary construction and are integrally joined together at a juncture (12) along corresponding interior edges of the first plate (20) and second plate (30).

As will be described in greater detail below, as shown in FIG. 1, first plate (20) is configured to allow horizontal movement between adjacent building components, while second plate (30) is configured to allow vertical movement between adjacent building components. As will also be described in greater detail below, second plate (30) includes enhanced coupling features configured to maintain suitable securement between second plate (30) and its corresponding building component while accommodating for various forces to be transmitted through second plate (30) during exemplary use.

As shown, first plate (20) and second plate (30) extend away from juncture (12) along a respective axis (A1, A2). Additionally, juncture (12) extends along a respective axis (A3) such that, in the current example, axes (A1, A2, A3) are all substantially perpendicular with each other. However, this is merely optional, as plates (20, 30) may be arranged at any suitable angle relative to each other. In addition, plates (20, 30) may bend relative each other about juncture (12) and axis (A3) such that plates (20, 30) and axis (A1, A2) are not perpendicular with each other during exemplary use. Clip (10) can be created using a conventional forming process to bend first plate (20) and second plate (30) into the desired configuration.

In some embodiments, first plate (20) may comprise a length (i.e., the dimension measured along axis (A1) from juncture (12) to the free edge of first plate (20)) of about 3.75 inches. Other suitable lengths for first plate (20) may be apparent based on the teachings herein. In some embodiments, second plate (30) may comprise a length (i.e., the dimension measured along axis (A2) from juncture (12) to the free edge of second plate (30)) within the range of about 3.5 inches to about 16 inches. Other suitable lengths of second plate (30) may be apparent based on the teachings herein. That dimension of second plate (30) may correspond to the standoff condition for the desired application of the clip (10) (e.g., the length of second plate (30) may increase as the standoff condition increases). The standoff condition or standoff distance refers to the distance between the location on horizontal building component (52) where clip (10) is attached thereto and the location on vertical building component (54) where clip (10) is attached thereto in a wall assembly. For example, in the embodiment shown in FIG. 3, the standoff condition refers to the distance between the outer face of the vertical leg of angle flange (52*a*) and a central portion of the web of stud (54*a*). The standoff condition for a typical wall assembly ranges from about 1 inch to about 5 inches, but other standoff conditions may be desirable depending on the particular application. In some embodiments, first plate (20) and second plate (30) may comprise a width (i.e., the dimension measured along axis (A3) from the respective upper edge (20*a*, 30*a*) to the corresponding lower edge (20*b*, 30*b*) of plates (20, 30)) of about 5.5 inches. Other suitable widths for plates (20, 30) may be apparent based on the teachings herein.

In the illustrated embodiment, first plate (20) includes a pair of elongated drift slots (22). Of course, in other embodiments first plate (20) may include a single slot or three or more slots. In some embodiments, drift slots (22) may comprise a length in the direction of axis (A1) ranging from about 2 inches to about 2.375 inches long. In other embodiments, drift slots (22) may comprise any other length suitable to provide the desired amount of drift. In some embodiments, the length of drift slots (22) may increase in proportion to an increase in the length of first plate (20). In the illustrated embodiment, both drift slots (22) share the same dimensions (e.g., length and width) as each other. In other embodiments, at least one dimension of at least one drift slot (22) may vary relative to the other drift slot(s) (22).

As shown, drift slots (22) extend substantially parallel relative to each other and relative to axis (A1). Therefore, drift slots (22) also extend substantially perpendicular relative to axis (A3) and second plate (30). Drift slots (22) may be configured to receive a fastener, such as a shoulder screw, a standard screw and stepped bushing, or any other fastener suitable to slidably connect first plate (20) to an underlying building component. Drift slots (22) and fasteners are configured to couple clip (10) with an underlying building component, while allowing the underlying building component to move relative to clip (10) in the direction defined by drift slots (22) extending along axis (A1). When coupled with the underlying building component, rear surface (23) of first plate (20) may slidably contact the underlying building component. In the current embodiment, first plate (20) also includes measurement indicia (24) adjacent to one or more of drift slots (22) to facilitate placement of a fastener within a respective drift slot (22).

Clip (10) also comprises a plurality of stiffener darts (14) positioned within juncture (12). As shown, clip (10) includes five stiffener darts (14) positioned within juncture (12). Of course, in other embodiments, clip (10) may include a single stiffener dart (14), two stiffener darts (14), three stiffener darts (14), four stiffener darts, or six or more stiffener darts (14) positioned within juncture (12). Stiffener darts (14) can be positioned at any suitable location along juncture (12). In other embodiments, stiffener darts (14) may be omitted entirely. Stiffener darts (14) can be formed by any suitable manufacturing process, including but not limited to using special tooling to form stiffener darts (14) while clip (10) is being bent along juncture (12). In this embodiment, stiffener darts (14) protrude into an interior space between the interior surface (21) of first plate (20) and an interior surface (31) of second plate (30) such that the front surface (11) of juncture (12) is raised while the rear surface (13) of juncture (12) is correspondingly indented to form stiffener darts (14).

In some embodiments, stiffener darts (14) can include a ridge that forms a straight line substantially perpendicular to the axis (A3) of juncture (12). The respective ends of the ridge can intersect first plate (20) and second plate (30) at an angle relative to axis (A1, A2). In some embodiments, that angle between the ridge and the respective plate (20, 30) can be about 45 degrees. Stiffener darts (14) can include curved surfaces formed on either side of the ridge. In some embodiments, those curved surfaces can result in stiffener darts (14) having a substantially triangular outline. The curved surfaces of each stiffener dart (14) can taper into the bend of clip (10) along juncture (12). In some embodiments, stiffener darts (14) extend about 0.5 inches along first plate (20) and second plate (30), resulting in a ridge length of about 0.6 inches. In other embodiments, stiffener darts (14) may comprise other dimensions configured to provide sufficient stiffness depending on the particular application intended for clip (10). The particular shape and size of stiffener darts (14) may correspond to the shape and size of the tooling used to form stiffener darts (14).

In the current example, first plate (20) also includes a plurality of stiffener ribs (26) that extends from selected stiffener darts (14) toward a free edge of first plate (20). Similar to drift slots (22), stiffener ribs (26) also extend substantially parallel to axis (A1). While in the current example, three stiffener ribs (26) are used, any suitable number of stiffener ribs (26) may be used as would be apparent to one skilled in the art in view of the teachings herein. In some embodiments, stiffener ribs (26) may be omitted entirely. Additionally, stiffener ribs (26) may be placed along any suitable position on first plate (20) as would be apparent to one skilled in the art in view of the teachings herein. In the illustrated example, stiffener ribs (26) extend all the way from juncture (12) and stiffener dart (14) to the free edge of first plate (20). In some embodiments, stiffener ribs (26) may only extend along a portion of first plate (20). For example, stiffener ribs (26) may not extend all the way to the free end of first plate (20). Additionally or alternatively, stiffener ribs (26) may stop prior to reaching juncture (12) and/or stiffener dart (14). In this embodiment, stiffener ribs (26) protrude from first plate (20) such that the portion of stiffener ribs (26) on interior surface (21) are raised and the portion of stiffener ribs (26) on the rear surface (23) of first plate (20) ribs (26) are indented to form stiffener ribs (26).

Stiffener darts (14) and stiffener ribs (26) can be configured to increase the rigidity and stiffness of clip (10). Particularly, in some embodiments, stiffener darts (14) can be configured to increase the stiffness of the flat portions of first plate (20) and second plate (30) adjacent to juncture (12); while stiffener ribs (26) can be configured to increase the stiffness along the length of first plate (20).

Second plate (30) includes a plurality of elongated deflection slots (32) and a pair of elongated, aligned coupling slots (34). Slots (32, 34) extend substantially perpendicular relative to the axis (A2) along which second plate (30) extends from juncture (12) such that slots (32, 34) extend substantially parallel with the axis (A3) along which juncture (12) extends. In some embodiments, deflection slots (32) may each be about 4 inches long in the direction of axis (A3) and coupling slots (34) may each be about 1 inch long in the direction of axis (A3). In other embodiments, slots (32, 34) may be any length suitable to provide the desired amount of deflection. The respective lengths of slots (32, 34) may increase in proportion to an increase in the width of second plate (30). In the illustrated embodiment, both deflection slots (32) share the same dimensions (e.g., length and width) as each other and both coupling slots (34) share the same dimensions (e.g., length and width). In other embodiments, at least one dimension of at least one deflection slot (32) may vary relative to the other deflection slot(s) (32) and/or at least one dimension of at least one coupling slot (34) may vary relative to the other coupling slot(s) (34).

Coupling slots (34) are both offset from juncture (12) a first distance (d1); while a first deflection slot (32) is offset from juncture (12) a second distance (d2); and a second deflection slot (32) is offset from juncture (12) a third distance (d3). Any suitable distances (d1, d2, d3) may be used depending on the particular application. In some embodiments distance (d1) may be about 1.5 inches to about 5.5 inches depending on the desired standoff condition. In addition, in some embodiments, distance (d2) may be about 2.5 inches to about 6.5 inches depending on the desired standoff condition. Further, in some embodiments, distance (d3) may be about 3.5 inches to about 7.5 inches depending on the desired standoff condition. The distances (d1, d2, d3) may correspond to the desired standoff condition and/or the length of the second plate (30) along axis (A2). For example, the distances (d1, d2, d3) may increase as the length of second plate (30) along axis (A2) increases. In addition, in some embodiments, distance (d1) may be about 0.5 inches larger than the desired standoff condition, and distance (d2) may be about 1 inch larger than distance (d1), and distance (d3) may be about 2 inches larger than distance (d1).

In the current embodiment, coupling slots (34) are shorter than deflection slots (32). In such an embodiment, assuming fasteners (53) are installed at the midpoint of their respective slots (32, 34), the amount of deflection allowed by clip (10) will be limited by the length of coupling slots (34). Deflection slots (32) and coupling slots (34) may be dimensioned relative to each other so that clip (10) allows for the desired amount of deflection.

As shown in the illustrated embodiment, deflection slots (32) and coupling slots (34) are arranged such that the midpoint of upper coupling slot (34) is above the respective midpoints of deflection slots (32) and the midpoint of lower coupling slot (34) is below the respective midpoints of deflection slots (32). In other words, the midpoint of upper coupling slot (34) is closer to upper edge (30*a*) of second plate (30) than the respective midpoints of deflection slots (32) and the midpoint of lower coupling slot (34) is closer to lower edge (30*b*) of second plate (30) than the respective midpoints of deflection slots (32). In addition, as shown, deflection slots (32) and coupling slots (34) are arranged such that the uppermost edges (32*a*) of deflection slots (32) are closer to the upper edge (30*a*) of second plate (30) than the uppermost edge (34*a*) of the upper coupling slot (34). Similarly, the lowermost edges (32*b*) of deflection slots (32) are closer to the lower edge (30*b*) of second plate (30) than the lowermost edge (34*b*) of the lower coupling slot (34). In other embodiments, the arrangement of coupling slots (34) and deflection slots (32) relative edges (30*a*, 30*b*) may be reversed. For example, in slide clip (210) shown in FIG. 8, an uppermost edge (234*a*) of the upper coupling slot (234) is closer to the upper edge (230*a*) of second plate (230) than the uppermost edges (232*a*) of deflection slots (232); while lowermost edge (234*b*) of the lower coupling slot (234) is closer to the lower edge (230*b*) of second plate (230) than the lowermost edges (232*b*) of deflection slots (232). In still other embodiments, as exemplified in slide clip (310) shown in FIG. 9, the uppermost and lowermost edges (332*a*, 332*b*) of deflection slots (332) may be substantially the same distance away from the respective upper and lower edges (330*a*, 330*b*) of second plate (330) as uppermost edge (334*a*) of the upper coupling slot (334) and the lowermost edge (334*b*) of the lower coupling slot (334). In some embodiments, slots (32, 34) may be arranged such that their respective uppermost and lowermost edges (32*a*, 32*b*, 34*a*, 34*b*) are at least about 0.5 inches from the nearest edge (30*a*, 30*b*) of second plate (30).

In the illustrated embodiment, coupling slots (34) are offset the shortest distance (d1) from juncture (12). In other words, coupling slots (34) are closer to juncture (12) than the first deflection slot (32) (i.e., the deflection slot (32) closest to juncture (12)). Coupling slots (34) are "aligned" in the sense both slots (34) are offset substantially the same distance (d1) from juncture (12) and, thus, the longitudinal axes of coupling slots (34) are aligned with each other. Therefore, coupling slots (34) are separated from each other a distance along an axis parallel with juncture (12). While in the current example, two coupling slots (34) are aligned with each other extending along a longitudinal axis parallel with axis (A3), any suitable number of coupling slots (34) may be used as would be apparent to one skilled in the art in view of the teachings herein. For instance, three coupling slots (34) may be formed in second plate (30), where each coupling slot (34) is substantially offset a first distance (d1) from juncture (12). As will be described in greater detail below, coupling slots (34) may be used to enhance the coupling of second plate (30) with a corresponding building component in order to accommodate for various forces to be transmitted through second plate (30) during exemplary use.

Similar to drift slots (22) described above, slots (32, 34) may also be configured to receive a fastener, such as a shoulder screw, a standard screw and stepped bushing, or any other fastener suitable to slidably connect clip (10) to an underlying building component. Slots (32, 34) and fasteners are configured to couple clip (10) with an underlying building component, while allowing the underlying building component to move relative to clip (10) in the direction defined by slots (32, 34) extending parallel with axis (A3). When coupled with the underlying building component, rear surface (33) of second plate (30) may slidably contact the underlying building component. In the current embodiment, first plate (30) also includes measurement indicia (35) adjacent to one or more of slots (32, 34) to facilitate placement of a fastener within a respective slot (32, 34).

While in the current example, two deflection slots (32) are shown (each offset a corresponding distance (d2, d3) from juncture (12)), any suitable number of deflection slots (32) (having a separate corresponding distance from juncture (12)) may be used as would be apparent to one skilled in the art in view of the teachings herein. By way of example only, some embodiments of clip (10) may include three or more deflection slots (32). Similarly, while one group of coupling slots (34) (i.e. slots offset a similar distance (d1) from juncture (12)) are used, any suitable number of groups of coupling slots (34) may be used as would be apparent to one skilled in the art in view of the teachings herein. For example, a second group of aligned coupling slots (34) may be placed a fourth distance from juncture (12), where that fourth distance is between first distance (d1) and second distance (d2). In such an embodiment, the second group of coupling slots may be positioned laterally between the first group of coupling slots (i.e., the group of coupling slots closes to juncture (12)) and the first deflection slot (32) (i.e., the deflection slot (32) closest to juncture (12)).

In the current example, individual slots (32, 34) in second plate (30) are positioned within a stiffener region (38). In the embodiment shown in FIGS. 1-3, each slot (32, 34) is positioned within stiffener region (38). In the illustrated embodiment, stiffener regions (38) are formed by embossing a raised channel (36) into second plate (30). Channel (36) can be rounded in some embodiments. As shown, channel (36) defines each stiffener region (38) by defining an enclosed substantially rectangular area (37). In some embodiments, one or more stiffener regions may be defined by a channel that does not enclose the entire region around a respective slot. In still other embodiments, channels (36) and stiffener regions (38) may be omitted entirely.

Figure 3:
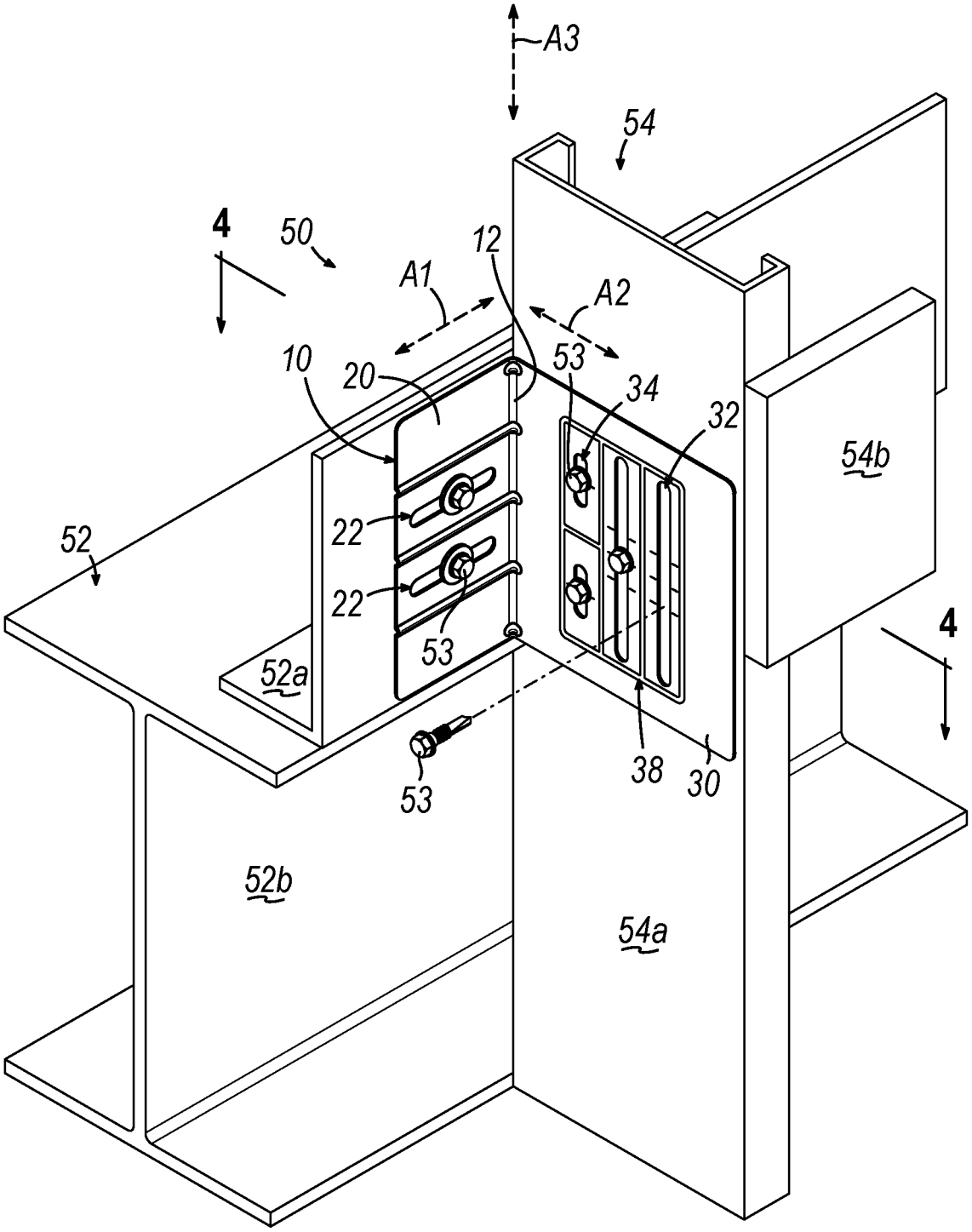
FIG. 3 depicts a perspective assembly view of the slide clip of FIG. 1 installed in an exemplary embodiment of a building structure.

In the embodiment illustrated in FIGS. 1-3, channel (36) includes a plurality of transverse channel members (36*a*), longitudinal channel members (36*b*), and a medial longitudinal channel (36*c*) that are all connected to each other to form a continuous channel (36). As shown, transverse channel members (36*a*) extend substantially parallel to axis (A3) of juncture (12), while longitudinal channel members (36*b*) and medial longitudinal channel (36*c*) extend substantially parallel with axis (A2) of second plate (30). In the current example, channel members (36*a*, 36*b*, 36*c*) cooperatively surround each individual slot (32, 34), although this is merely optional. In this embodiment, channel (36) protrudes into the interior space between interior surface (21) of first plate (20) and an interior surface (31) of second plate (30) such that the interior surface (31) of second plate (30) is raised while the exterior surface (33) of second plate (30) is correspondingly indented to form channel (36). Stiffener regions (38) can be configured to increase the rigidity and stiffness of clip (10).

In some embodiments, at least one of the transverse channel members (36*a*), longitudinal channel members (36*b*), or medial channel member (36*c*) may be separated or disconnected from at least one other transverse channel member (36*a*), longitudinal channel member (36*b*), or medial channel member (36*c*). By way of example only, in some embodiments a first channel may be formed substantially around at least a portion of a first stiffener region and a second channel may be formed around at least a portion of a second stiffener region such that the first channel and the second channel are disconnected from each other. In another example, a clip comprises individual channels that define an individual stiffener region around each slot, but each channel is disconnected from the channel defining the adjacent stiffener region.

Figure 4A:
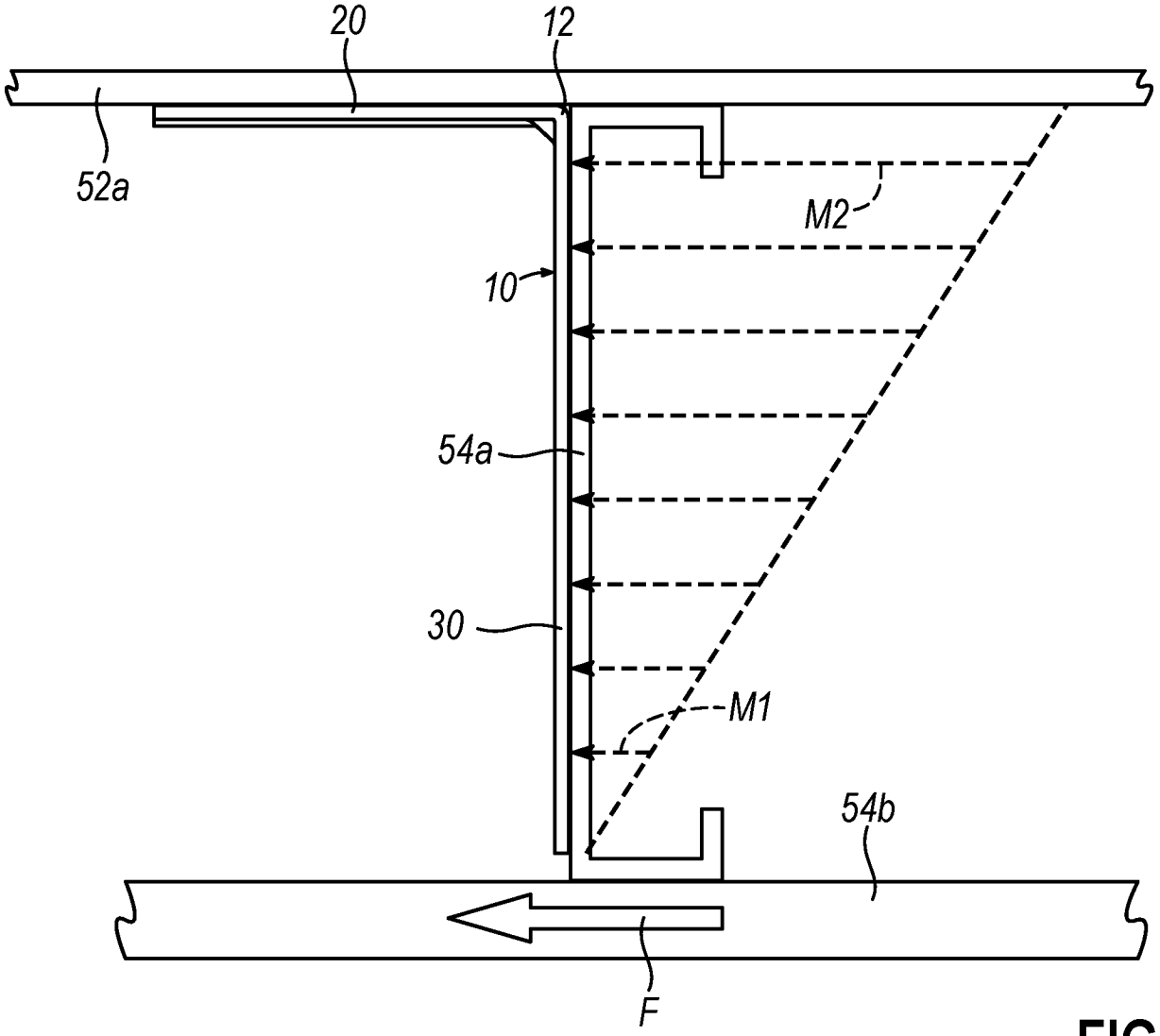
FIG. 4A depicts a cross-sectional view, taken along line 4-4 of FIG. 3, of the slide clip of FIG. 1 installed on the exemplary building structure, where a wall of the exemplary building structure is experiencing a lateral in-plane load in a first direction.
Figure 4B:
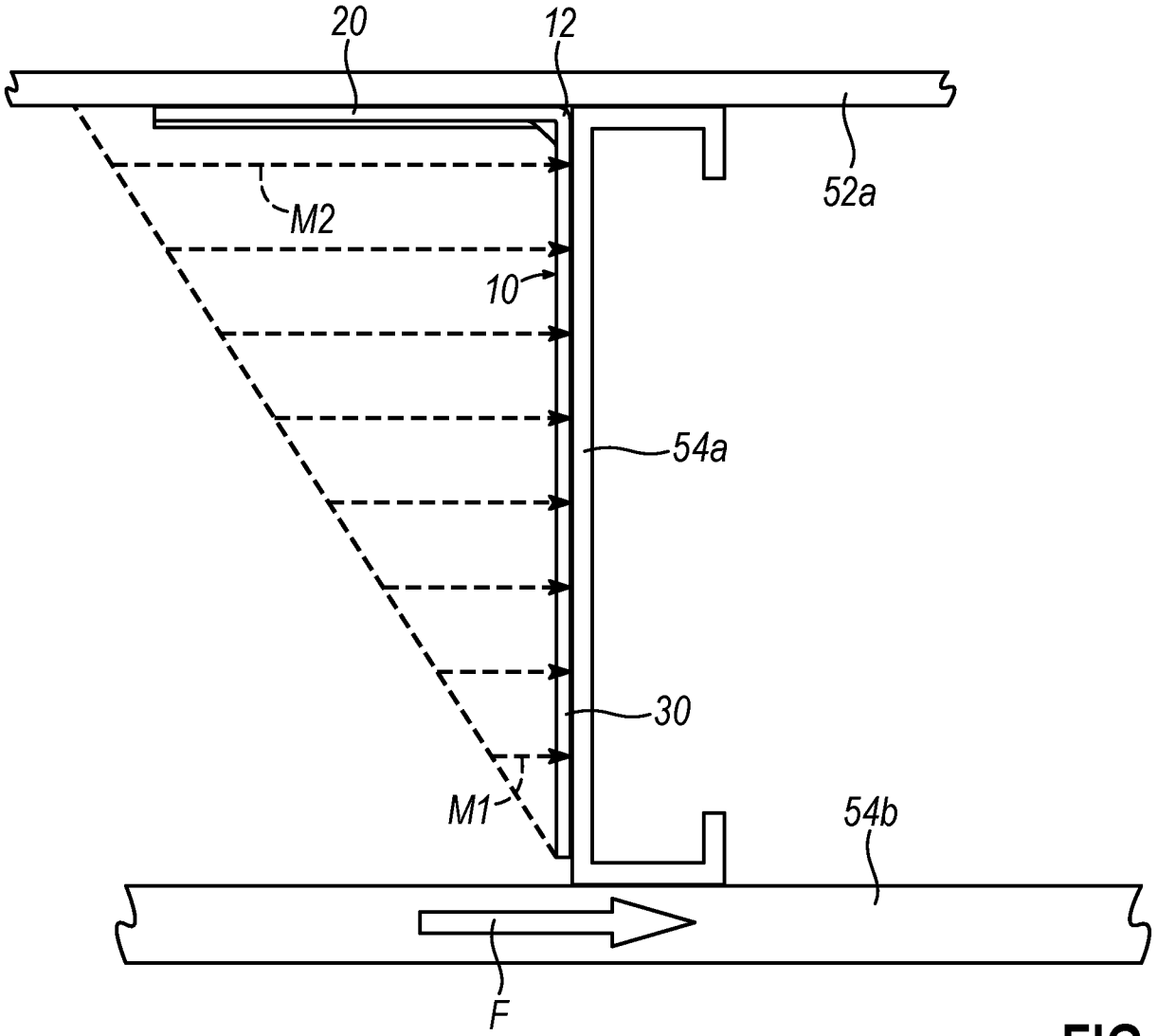
FIG. 4B depicts a cross-sectional view, taken along line 4-4 of FIG. 3, of the slide clip of FIG. 1 installed on the exemplary building structure, where the wall of the exemplary building structure is experiencing a lateral in-plane load in a second direction.

In FIGS. 3-4B, clip (10) is shown in a portion of an assembled building structure (50). As shown, clip (10) is configured to connect a substantially horizontal building component (52) (i.e., a supporting structure) and an adjacent substantially vertical building component (54) (i.e., a supported structure). In this embodiment, horizontal building component (52) comprises an angle flange or pour stop (52*a*) attached to a load bearing structural I-beam (52*b*) and vertical building component (54) comprises a stud (54*a*) coupled to an exterior wall member (54*b*). Exterior wall member (54*b*) may comprise any suitable material, including but not limited to gypsum sheathing, plywood, metal building panels, and metal lath. In some embodiments, stud (54*a*) may comprise a curtain-wall stud and exterior wall member (54*b*) may comprise a curtain-wall or portion thereof. Angle flange (52*a*) may be configured to retain a flooring material, such as concrete, that can be used to create a floor/ceiling in building structure (50). By way of example only, angle flange (52*a*) may be used in conjunction with a fluted deck.

In the illustrated embodiment, first plate (20) is attached to horizontal building component (52). Specifically, first plate (20) is attached to an outer face of the vertical leg of angled flange (52*a*). In some embodiments, first plate (20) can be attached to other suitable portions of horizontal building component (52), including the vertical web of I-beam (52*b*). In some embodiments, clip (10) can be positioned such that the exterior face (23) of first plate (20) is in contact with a surface of horizontal building component (52), such as the outer face of the vertical leg of angled flange (52*a*) or the outer face of the vertical web of I-beam (52*b*). First plate (20) is attached to horizontal building component (52) such that horizontal building component (52) can slidably move in a horizontal direction (i.e., in the direction of axis (A1)) relative to clip (10) and vertical building component (54) even after clip (10) is installed in building structure (50). First plate (20) can be attached to horizontal building component (52) using one or more conventional fasteners (53), such as shoulder screws, standard screws with stepped bushings, or any other fasteners configured to cooperate with clip (10) to allow horizontal building component (52) to slidably move horizontally (i.e., in the direction of axis (A1)) relative to clip (10) and vertical building component (54). Any suitable number of fasteners (53) may be used and fasteners (53) may be installed in one or more of drift slots (22) on first plate (20). For example, in some embodiments a single fastener (53) may be installed in one or more of drift slots (22), while in other embodiments two or more fasteners (53) may be installed in one or more of drift slots (22). The number of fasteners (53) installed in each of drift slots (22) may be the same in some embodiments, while the number of fasteners (53) installed in two or more of drift slots (22) may vary in other embodiments. Additionally, in some embodiments, at least one fastener (53) is installed through each drift slot (22), while in other embodiments, one or more of drift slots (22) may not have any fasteners (53) installed therein.

In the illustrated embodiment, second plate (30) is attached to vertical building component (54), which includes stud (54*a*). Specifically, second plate (30) is attached to an outer surface of the web of stud (54*a*). In some embodiments, clip (10) can be positioned such that exterior surface (33) of second plate (30) is in contact with a surface of vertical building component (54), such as the outer surface of the web of stud (54*a*). Second plate (30) is attached to vertical building component (54) such that vertical building component (54) can slidably move in a vertical direction (i.e., the direction of axis (A3)) relative to clip (10) and horizontal building component (52) even after clip (10) is installed in building structure (50). Similar to first plate (20) discussed above, second plate (30) can also be attached to vertical building component (54) using one or more conventional fasteners (53) through respective slots (32, 34), such as shoulder screws, standard screws with stepped bushings, or any other fasteners configured to cooperate with clip (10) to allow vertical building component (54) to slidably move vertically (i.e., in the direction of axis (A3)) relative to clip (10) and horizontal building component (52). Any suitable number of fasteners (53) may be used and fasteners (53) may be installed in one or more of slots (32, 34) on second plate (30). For example, in some embodiments a single fastener (53) may be installed in one or more of slots (32, 34), while in other embodiments two or more fasteners (53) may be installed in one or more of slots (32, 34). The number of fasteners (53) installed in each of slots (32, 34) may be the same in some embodiments, while the number of fasteners (53) installed in two or more of slots (32, 34) may vary in other embodiments. Additionally, in some embodiments, at least one fastener (53) is installed through each slot (32, 34), while in other embodiments, one or more of slots (32, 34) may not have any fasteners (53) installed therein.

Furthermore, in some embodiments a single fastener (53) may be installed in one or more of coupling slots (34), while in other embodiments two or more fasteners (53) may be installed in one or more of coupling slots (34). Similarly, in some embodiments a single fastener (53) may be installed in one or more of deflection slots (32), while in other embodiments two or more fasteners (53) may be installed in one or more of deflection slots (32). In addition, the number of fasteners (53) installed in each of coupling slots (34) may be the same in some embodiments, while the number of fasteners (53) installed in each of coupling slots (34) may vary in other embodiments. Similarly, the number of fasteners (53) installed in each of deflection slots (32) may be the same in some embodiments, while the number of fasteners (53) installed in two or more of deflection slots (32) may vary in other embodiments. Additionally, in some embodiments, at least one fastener (53) is installed through each coupling slot (34), while in other embodiments, one or more of coupling slots (34) may not have any fasteners (53) installed therein. As discussed in more detail below with regard to FIGS. 4A and 4B, having at least one fastener (53) installed in each coupling slot (34) may allow clip (10) to withstand larger loads compared to embodiments where at least one coupling slot (34) does not have any fasteners (53) installed therein. In some embodiments, at least one fastener (53) is installed through each deflection slot (32), while in other embodiments, one or more of deflection slots (32) may not have any fasteners (53) installed therein. In some embodiments, a single fastener may be installed in each slot (32, 34) aligned with the central measurement indicia (35) adjacent the respective slot (32, 34). Increasing the number of fasteners (53) installed in one or more slots (32, 34) may increase the load clip (10) is capable of withstanding.

As mentioned above, some external loads experienced on an exterior wall member (54*b*) may be transmitted to the stud (54*a*), the clip (10), and the horizontal building component (52). As best shown in FIGS. 4A-4B, in some instances, the exterior wall member (54*b*) may experience a "lateral in-plane load" (F). This type of load (F) may also be referred to as a "flap load." Such a load (F) may be generated by a force, such as a wind or seismic force, acting on the exterior face of exterior wall member (54*b*) or a corresponding cladding/façade. Of course, such a lateral in-plane load (F) may be generated through any other suitable force as would be apparent to one skilled in the art in view of the teachings herein.

As also mentioned above, clip (10) acts as a structural support for stud (54*a*) and exterior wall member (54*b*) such that lateral in-plane loads (F) acting on vertical building member (54) or components thereof (e.g., exterior wall member (54*b*)) may be transmitted to horizontal building component (52) via clip (10). Because second plate (30) is coupled to stud (54*a*), lateral in-plane loads (F) may be transferred from exterior wall member (54*b*) to stud (54*a*) via the connection point(s) between exterior wall member (54*b*) and stud (54*a*), and from stud (54*a*) to second plate (30) via fasteners (53) securing second plate (30) to stud (54*a*). Additionally, because second plate (30) extends away from horizontal building component (52) at juncture (12), this lateral in-plane load (F) may generate a torque and increasing bending moment (M1, M2) within second plate (30), causing second plate (30) to either "fold" (i.e. deform either elastically or plastically) toward (FIG. 4A) or away (FIG. 4B) first plate (20), depending on the direction of the lateral in-plane load (F). Such folding of plates (20, 30) may be substantially about axis (A3) defined by juncture (12) such that plates (20, 30) collapse inwardly, collapse outwardly, or otherwise deform near axis (A3) toward or away from each other while experiencing a lateral in-plane load (F).

Because the load (F) is offset from second plate (30), the resulting torque and bending moment (M2) located closer to juncture (12) may be greater than the resulting torque and bending moment (M1) located at the free end of second plate (30). As mentioned above, and as will also be described in greater detail below, second plate (30) includes enhanced coupling features configured to maintain suitable securement between second plate (30) and its corresponding building component while accommodating for lateral in-plane loads (F) to be transmitted through second plate (30) during exemplary use.

In particular, in the illustrated embodiment, second plate (30) includes coupling slots (34), each configured to receive at least one faster (53). Since coupling slots (34) are aligned in accordance with the description above (i.e. offset from juncture (12) substantially the same distance (d1), which is closer to juncture (12) than other distances (d2, d3) of deflection slots (32)), each fastener (53) within its respective slot (34) may share the resulting load/moment generated from the lateral in-plane load (F). This sharing of the resulting load/moment between fasteners (53) within aligned slots (34) may allow second plate (30) to maintain suitable securement with stud (54*a*) while experiencing a lateral in-plane load (F) that generates a greater bending moment (M2) near juncture (12) compared to the bending moment (M1) at the free end of second plate (30).

As mentioned above, coupling slots (34) are located closest to juncture (12) as compared to deflection slots (32). Therefore, deflection slots (32) are generally located along a portion of second plate (30) that may experience a lesser bending moment/torque from a lateral in-plane load (F) as compared to the portion of second plate (30) where coupling slots (34) are located as described above. As a result, deflection slots (32) may only require one fastener (53) to maintain suitable securement between second plate (30) and stud (54*a*) while experiencing a lateral in-plane load (F) that generates a bending moment (M1, M2) that gradually increases along the length of second plate (30) from the free edge thereof toward juncture (12).

The presence of two coupling slots (34) and, thus, two fasteners located in those slots, may allow clip (10) to withstand a larger flap load compared to prior art clips that included a single slot and single fastener located closest to the juncture of the clip. As discussed above, having multiple slots, such as coupling slots (34), located closest to juncture (12) may be beneficial because that is where the highest concentration of load (F) will be located. In addition, having multiple coupling slots (34) that are aligned with each other and located closest to juncture (12) and include at least one fastener (53) in each coupling slot (34) may prevent rotation and torsional loading, which may provide additional support at a common failure point of prior art clips that only included one slot and one fastener closest to the juncture. Embodiments that include two coupling slots (34) and a fastener (53) in each slot, such as the illustrated embodiment, may provide twice the screw load resistance compared to prior art clips with a single clip and single fastener located closest to the juncture.

In addition, the use of multiple individual coupling slots (34) with a fastener (53) in each of the coupling slots (34) may provide several benefits compared to clips with a single coupling slot with one or more fasteners in the single coupling slot, even in clips where the single coupling slot has a length that is substantially equal to or greater than the length from the uppermost edge (34*a*) of the upper coupling slot (34) to the lowermost edge (34*b*) of the lower coupling slot (34) in the illustrated embodiments. For example, embodiments with multiple individual coupling slots (34), such as those illustrated herein, may be able to withstand a higher load than a clip with a single coupling slot and multiple fasteners therein. Additionally, embodiments with multiple individual coupling slots (34) may also facilitate installation by providing automatic or predefined spacing between fasteners (53) installed in coupling slots (34). Having proper spacing between fasteners (53) in coupling slots (34) may improve the load capacity of the clip (10) while also ensuring the clip (10) can provide the desired amount of deflection. Clips with a single coupling slot of greater length provide a greater opportunity for users to install fasteners incorrectly within the coupling slot (e.g., too close together, too far apart, not aligned within the slot correctly to provide the desired deflection, etc.). For example, installing fasteners at the midpoint of each coupling slot (34) may provide the largest amount of deflection in both directions, whereas achieving the largest amount of deflection in both directions by installing two fasteners in a single slot would require locating each fastener at a specific location within the slot relative to both the ends of the slot and the other fastener. Neither of those locations would be the midpoint of the single slot, and, thus, may be more difficult to locate.

II. Slide Clip Allowing Vertical Movement

Figure 5:
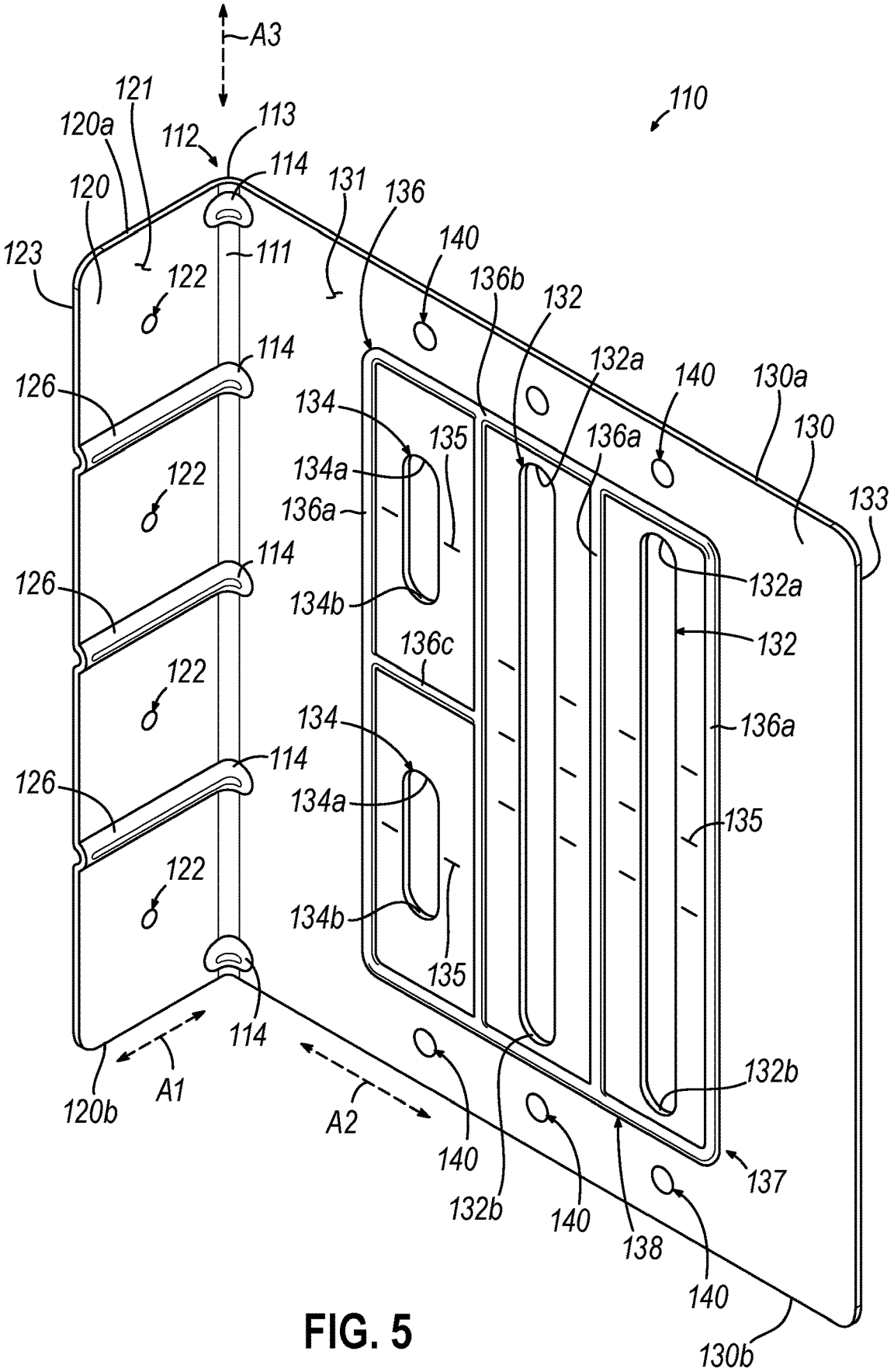
FIG. 5 depicts a perspective view of another exemplary slide clip.
Figure 6:
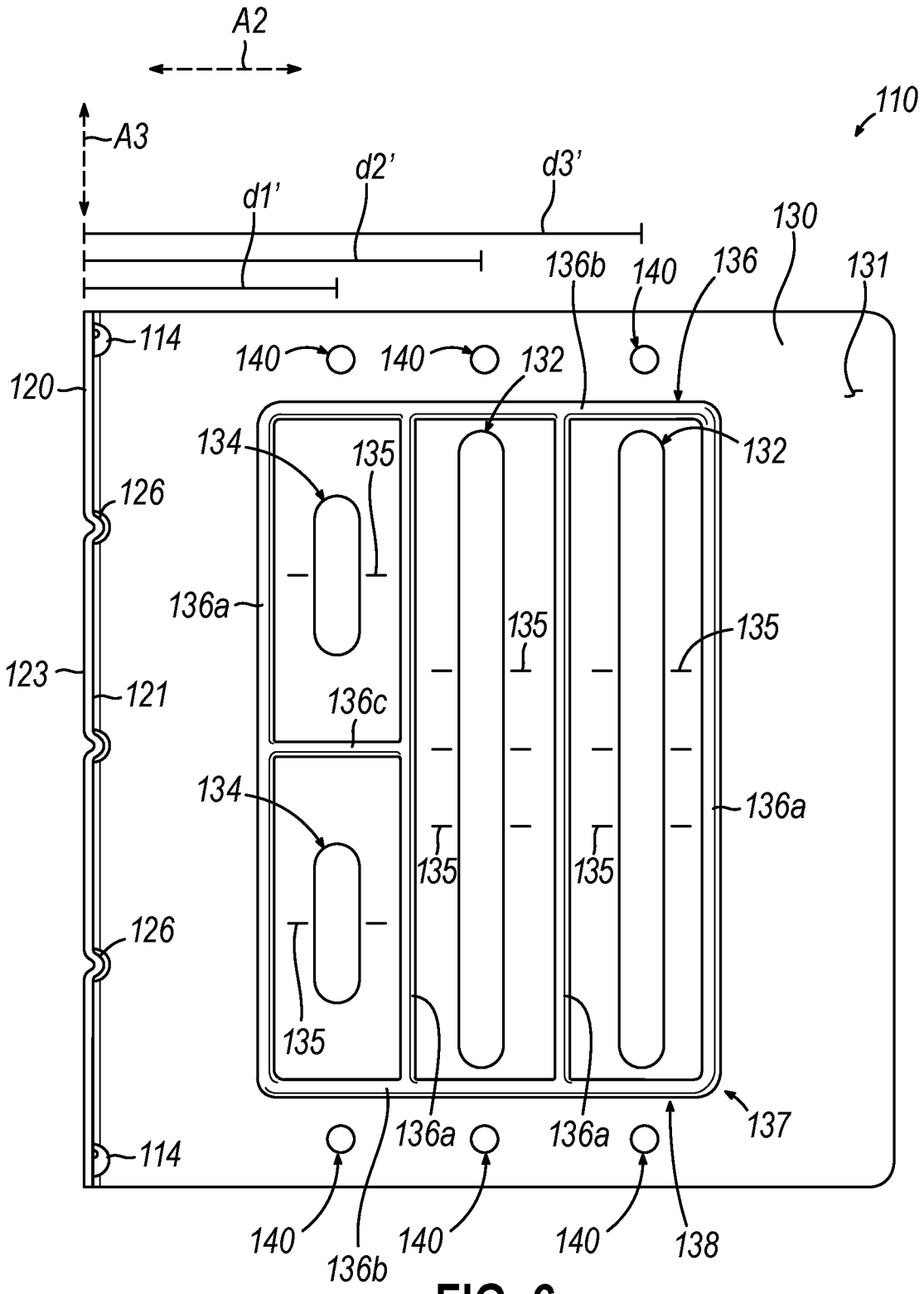
FIG. 6 depicts a front elevational view of the slide clip of FIG. 5.

FIGS. 5-6 illustrate an example of a slide clip (110) configured to allow for vertical movement between adjacent building components connected by clip (110). Slide clip (110) may be substantially similar to slide clip (10) described above, with differences discusses below. While slide clip (10) described above is configured to allow both vertical and horizontal movement between adjacent building components connected by slide clip (10), slide clip (110) is configured to primarily allow for vertical movement between adjacent building components, while remaining substantially fixed in the horizontal direction.

Slide clip (110) includes a first plate (120) and a second plate (130). Second plate (130) is substantially similar to second plate (30) described above, with differences discussed below. First plate (120) and second plate (130) can be formed from a single piece of material so that first plate (120) and second plate (130) are of unitary construction and are integrally joined together at a juncture (112) along corresponding interior edges of the first plate (120) and second plate (130).

As shown, first plate (120) and second plate (130) extend away from juncture (112) along respective axes (A1, A2). Additionally, juncture (112) extends along a respective axis (A3) such that, in the current example, axis (A1, A2, A3) are all substantially perpendicular with each other. However, this is merely optional, as plates (120, 130) may be arranged at any suitable angle relative to each other. In addition, plates (20, 30) may bend relative each other about juncture (112) and axis (A3) such that plates (120, 130) and axis (A1, A2) are not perpendicular with each other during exemplary use. Clip (110) can be created using a conventional forming process to bend first plate (120) and second plate (130) into the desired configuration.

In some embodiments, first plate (120) may comprise a length (i.e., the dimension measured along axis (A1) from juncture (112) to the free edge of first plate (120)) of about 1.5 inches. Other suitable lengths for first plate (120) may be apparent based on the teachings herein. In some embodiments, second plate (130) may comprise a length (i.e., the dimension measured along axis (A2) from juncture (112) to the free edge of second plate (130)) within the range of about 3.5 inches to about 16 inches. Other suitable lengths for second leg (130) may be apparent based on the teachings herein. That dimension of second plate (130) may correspond to the standoff condition for the desired application of the clip (110) (e.g., the length of second plate (130) may increase as the standoff condition increases). By way of example only, in the embodiment shown in FIG. 7, the standoff condition refers to the distance between the outer face of the vertical leg of angle flange (52*a*) and a central portion of the web of stud (54*a*). The standoff condition for a typical wall assembly ranges from about 1 inch to about 5 inches, but other standoff conditions may be desirable depending on the particular application. In some embodiments, first plate (120) and second plate (130) may comprise a width (i.e., the dimension measured along axis (A3) from the respective upper edge (120*a*, 130*a*) to the corresponding lower edge (120*b*, 130*b*) of plates (120, 130)) of about 5.5 inches. Other suitable widths for plates (120, 130) may be apparent based on the teachings herein.

In this illustrated embodiment, first plate (120) includes a plurality of fastener indicia (122). As shown, fastener indicia (122) are arranged along a linear array along a direct parallel with axis (A3) of juncture (112). Fastener indicia (122) may be configured to receive at least a portion of fastener, such as a standard screw or any other fastener suitable to fixably attach first plate (120) to an underlying building component. Fastener indicia (122) and fasteners are configured to couple clip (110) with an underlying building component such that the underlying building component and clip (110) are substantially fixed relative to each other. When coupled with the underlying building component, rear surface (123) of first plate (120) may substantially contact the underlying building component.

In some embodiments, fastener indicia (122) may comprise guide holes that extend all the way through first plate (120) such that interior surface (121) and exterior surface (123) both define an interior opening and an exterior opening for each guide hole. In other embodiments, fastener indicia (122) may be dimples on the interior surface (121) of first plate (120) in order to facilitate placement of a fastener to be driven through first plate (120) by initially receiving a portion of the fastener, such as the tip.

Clip (110) also includes a plurality of stiffener darts (114) positioned within juncture (112). Stiffener darts (114) may be substantially similar to stiffener drafts (114) described above. Accordingly, stiffener darts (114) protrude into an interior space between the interior surface (121) of first plate (120) and an interior surface (131) of second plate (130) such that the front surface (111) of juncture (112) is raised while the rear surface (113) of juncture (112) is correspondingly indented to form stiffener darts (114).

First plate (120) also includes a plurality of stiffener ribs (126), which may be substantially similar to stiffener ribs (26) described above. Accordingly, stiffener darts (114) and stiffener ribs (126) can be configured to increase the rigidity and stiffness of clip (110). Particularly, in some embodiments, stiffener darts (114) can be configured to increase the stiffness of the flat portions of first plate (120) and second plate (130) adjacent to juncture (112); while stiffener ribs (126) can be configured to increase the stiffness along the length of first plate (120). In some embodiments, stiffener darts (114) and/or stiffener ribs (126) may be omitted entirely. In the illustrated example, stiffener ribs (126) extend all the way from juncture (112) and stiffener dart (114) to the free edge of first plate (120). In some embodiments, stiffener ribs (126) may only extend along a portion of first plate (120). For example, stiffener ribs (126) may not extend all the way to the free end of first plate (120). Additionally or alternatively, stiffener ribs (126) may stop prior to reaching juncture (112) and/or stiffener dart (114).

As mentioned above, second plate (130) is substantially similar to second plate (30) described above, with differences elaborated below. Therefore, second plate (130) includes a plurality of elongated deflection slots (132) and a pair of elongated, aligned coupling slots (134), which may be substantially similar to deflection slots (32) and aligned coupling slots (34) described above, respectively. Slots (132, 134) extend substantially perpendicular relative to the axis (A2) along which second plate (130) extends from juncture (112) such that slots (132, 134) extend substantially parallel with the axis (A3) along which juncture (112) extends. In some embodiments, deflection slots (132) may each be about 4 inches long in the direction of axis (A3) and coupling slots (134) may each be about 1 inch long in the direction of axis (A3). In other embodiments, slots (132, 134) may be any length suitable to provide the desired amount of deflection. The respective lengths of slots (132, 134) may increase in proportion to an increase in the width of second plate (130). In the illustrated embodiment, both deflection slots (132) share the same dimensions (e.g., length and width) as each other and both coupling slots (134) share the same dimensions (e.g., length and width). In other embodiments, at least one dimension of at least one deflection slot (132) may vary relative to the other deflection slot(s) (132) and/or at least one dimension of at least one coupling slot (134) may vary relative to the other coupling slot(s) (134).

Coupling slots (134) are both offset from juncture (112) a first distance (d1'); while a first deflection slot (132) is offset from juncture (112) a second distance (d2'); and a second deflection slot (132) is offset from juncture (112) a third distance (d3'). The first, second, and third distances (d1', d2', d3') mentioned in the previous sentence are similar to distances (d1, d2, d3) described above. Any suitable distances (d1', d2', d3') may be used depending on the particular application. In some embodiments distance (d1') may be about 1.5 inches to about 5.5 inches depending on the desired standoff condition. In addition, in some embodiments, distance (d2') may be about 2.5 inches to about 6.5 inches depending on the desired standoff condition. Further, in some embodiments, distance (d3') may be about 3.5 inches to about 7.5 inches depending on the desired standoff condition The distances (d1', d2', d3') may correspond to the desired standoff condition and/or the length of the second plate (30) along axis (A2). For example, the distances (d1', d2', d3') may increase as the length of second plate (30) along axis (A2) increases. In addition, in some embodiments, distance (d1') may be about 0.5 inches larger than the desired standoff condition, and distance (d2') may be about 1 inch larger than distance (d1'), and distance (d3') may be about 2 inches larger than distance (d1').

In the current embodiment, coupling slots (134) are shorter than deflection slots (132). In such an embodiment, assuming fasteners (53) are installed at the midpoint of their respective slots (132, 134), the amount of deflection allowed by clip (110) will be limited by the length of coupling slots (134). Deflection slots (132) and coupling slots (134) may be dimensioned relative to each other so that clip (110) allows for the desired amount of deflection.

As shown in the illustrated embodiment, deflection slots (132) and coupling slots (134) are arranged such that the midpoint of upper coupling slot (134) is above the respective midpoints of deflection slots (132) and the midpoint of lower coupling slot (134) is below the respective midpoints of deflection slots (132). In other words, the midpoint of upper coupling slot (134) is closer to upper edge (130*a*) of second plate (130) than the respective midpoints of deflection slots (132) and the midpoint of lower coupling slot (134) is closer to lower edge (130*b*) of second plate (130) than the respective midpoints of deflection slots (132). In addition, as shown, deflection slots (132) and coupling slots (134) are arranged such that the uppermost edges (132*a*) of deflection slots (132) are closer to the upper edge (130*a*) of second plate (130) than the uppermost edge (134*a*) of the upper coupling slot (134). Similarly, the lowermost edges (132*b*) of deflection slots (132) are closer to the lower edge (130*b*) of second plate (130) than the lowermost edge (134*b*) of the lower coupling slot (134). In other embodiments, the arrangement of coupling slots (134) and deflection slots (132) relative to edges (130*a*, 130*b*) may be reversed. For example, in slide clip (410) shown in FIG. 10, an uppermost edge (434*a*) of the upper coupling slot (434) is closer to the upper edge (430*a*) of second plate (430) than the uppermost edges (432*a*) of deflection slots (432); while lowermost edge (434*b*) of the lower coupling slot (434) is closer to the lower edge (430*b*) of second plate (430) than the lowermost edges (432*b*) of deflection slots (432). In still other embodiments, as exemplified in slide clip (510) shown in FIG. 11, the upper and lowermost edges (532*a*, 532*b*) of deflection slots (532) may be substantially the same distance away from the respective upper and lower edges (530*a*, 530*b*) of second plate (530) as uppermost edge (534*a*) of the upper coupling slot (534) and the lowermost edge (534*b*) of the lower coupling slot (534). In some embodiments, slots (132, 134) may be arranged such that their respective uppermost and lowermost edges (132*a*, 132*b*, 134*a*, 134*b*) are at least about 0.5 inches from the nearest edge (130*a*, 130*b*) of second plate (130).

In the illustrated embodiment, coupling slots (134) are offset the shortest distance from juncture (112). In other words, coupling slots (134) are closer to juncture (112) than the first deflection slot (132) (i.e., the deflection slot (132) closest to juncture (112)). Coupling slots (134) are "aligned" in the sense both slots (134) are offset substantially the same distance from juncture (112) and, thus, the longitudinal axes of coupling slots (134) are aligned with each other. Therefore, coupling slots (134) are separated from each other a distance along an axis parallel with juncture (112). While in the current example, two coupling slots (134) are aligned with each other, extending along a longitudinal axis parallel with axis (A3), any suitable number of coupling slots (134) may be used as would be apparent to one skilled in the art in view of the teachings herein. For instance, three coupling slots (134) may be formed in second plate (130), where each coupling slot (134) is substantially offset a first distance from juncture (112). In similar fashion to coupling slots (34) described above, coupling slots (134) may be used to enhance the coupling of second plate (130) with a corresponding building component in order to accommodate for various forces to be transmitted through second plate (130) during exemplary use.

Similar to slots (32, 34) described above, slots (132, 134) may also be configured to receive a fastener, such as a shoulder screw, a standard screw and stepped bushing, or any other fastener suitable to slidably connect second plate (120) to an underlying building component. Slots (132, 134) and fasteners are configured to couple clip (110) with an underlying building component, while allowing the underlying building component to move relative to clip (110) in the direction defined by slots (132, 134) extending parallel with axis (A3). When coupled with the underlying building component, rear surface (133) of second plate (130) may slidably contact the underlying building component. In the current embodiment, first plate (130) also includes measurement indicia (135) adjacent to one or more of slots (132, 134) to facilitate placement of a fastener within a respective slot (132, 134).

While in the current example, two deflection slots (132) are shown (each offset a corresponding distance (d2', d3') from juncture (112)), any suitable number of deflection slots (132) (having a separate corresponding distance from juncture (112)) may be used as would be apparent to one skilled in the art in view of the teachings herein. By way of example only, some embodiments of clip (110) may include three or more deflection slots (132). Similarly, while one group of coupling slots (134) (i.e. slots offset a similar distance from juncture (112)) are used, any suitable number of groups of aligned slots (134) may be used as would be apparent to one skilled in the art in view of the teachings herein. For example, a second group of coupling slots (134) may be placed a fourth distance from juncture (112), where that fourth distance is between first group of coupling slots (134) and the deflection slot (132) closest to the juncture. In such an embodiment, the second group of coupling slots may be positioned laterally between the first group of coupling slots (i.e., the group of coupling slots closes to juncture (112)) and the first deflection slot (132) (i.e., the deflection slot (132) closest to juncture (112)).

Additionally, second plate (130) includes a plurality of fastener guides (140). The illustrated embodiment includes six fastener guides (140) wherein a fastener guide (140) is positioned above and below coupling slots (134) and each deflection slot (132). As shown, fastener guides (140) are positioned between channel (136) and the respective nearest edge (130*a*, 130*b*) of second plate (130). In this embodiment, fastener guides (140) are aligned with the respective longitudinal axis of the adjacent slots (132, 134). Other embodiments may comprise any number of fastener guides arranged in other configurations, provided the number and configuration is suitable to allow second plate (130) to be fixedly attached to an underlying building component. Similar to fastener indicia (122), fastener guides (140) may be configured to receive a fastener, such as a standard screw or any other fastener suitable to fixedly attach second plate (130) to an underlying building component. In some applications where it may be desirable to fixedly attach second plate (130) to an underlying building component instead of allowing for relative movement between second plate (130) and the underlying building component, fasteners may be installed in fastener guides (140) instead of or in addition to slots (132, 134). Fastener guides (140) and fasteners are configured to couple clip (110) with an underlying building component such that the underlying building component and clip (110) are substantially fixed relative to each other. When coupled with the underlying building component, rear surface (133) of second plate (130) may substantially contact the underlying building component.

In some instances, fastener guides (140) extend all the way through second plate (130) such that interior surface (131) and exterior surface (133) both define an interior opening and exterior opening for each fastener guide (140). In other instances, fastener guides (140) may be dimples on the interior surface (131) of second plate (130) in order to initially guide a fastener to be driven through second plate (130) by initially receiving a portion of the fastener, such as the tip. It should be noted that some embodiments of clip (10) described above may include one or more fastener guides (140) in second plate (30).

In the current example, individual slots (132, 134) in second plate (130) are positioned within a stiffener region (138). In the embodiment shown in FIGS. 5-6, each slot (132, 134) is positioned within stiffener region (138). In the illustrated embodiment, stiffener regions (138) are formed by embossing a raised channel (136) into second plate (130). Channel (136) can be rounded in some embodiments. As shown, channel (136) defines each stiffener region (138) by defining an enclosed substantially rectangular area (137). In some embodiments, one or more stiffener regions may be defined by a channel that does not enclose the entire region around a respective slot. In still other embodiments, the stiffener (138) regions may be omitted entirely.

In the illustrated embodiment, channel (136) includes a plurality of transverse channel members (136*a*), longitudinal channel members (136*b*), and a medial longitudinal channel (136*c*) that are all connected to each other to form a continuous channel (136). As shown, transverse channel members (136*a*) extend substantially parallel to axis (A3) of juncture (112), while longitudinal channel members (136*b*) and medial longitudinal channel (136*c*) extend substantially parallel with axis (A2) of second plate (130). In the current example, channel members (136*a*, 136*b*, 136*c*) cooperatively surround each individual slot (132, 134), although this is merely optional. In this embodiment, channel (136) protrudes into the interior space between interior surface (121) of first plate (120) and an interior surface (131) of second plate (130) such that the interior surface (131) of second plate (130) is raised while the exterior surface (133) of second plate (130) is correspondingly indented to form channel (136). Stiffener regions (138) can be configured to increase the rigidity and stiffness of clip (110).

In some embodiments, at least one of the transverse channel members (136*a*), longitudinal channel members (136*b*), or medial channel member (136*c*) may be separated or disconnected from at least one other transverse channel member (136*a*), longitudinal channel member (136*b*), or medial channel member (136*c*). By way of example only, in some embodiments a first channel may be formed substantially around at least a portion of a first stiffener region and a second channel may be formed around at least a portion of a second stiffener region such that the first channel and the second channel are disconnected from each other. In another example, a clip comprises individual channels that define an individual stiffener region around each slot, but each channel is disconnected from the channel defining the adjacent stiffener region.

Figure 7:
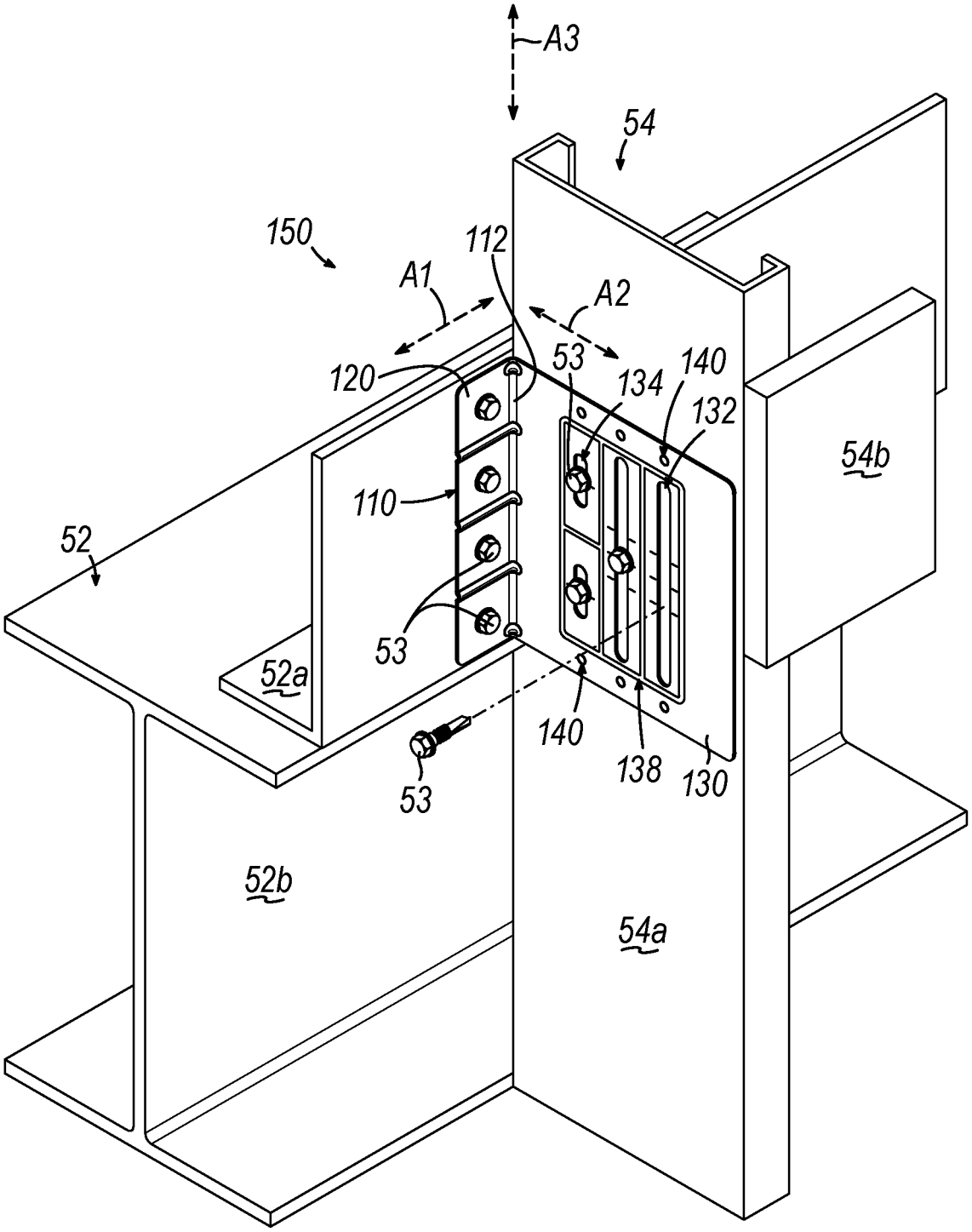
FIG. 7 depicts a perspective assembly view of the slide clip of FIG. 5 installed in an exemplary embodiment of a building structure.

In FIG. 7, clip (110) is shown in a portion of an assembled building structure (150). As shown, clip (110) is configured to connect a substantially horizontal building component (52) (i.e., a supporting structure) and an adjacent substantially vertical building component (54) (i.e., a supported structure). In this embodiment, horizontal building component (52) comprises an angle flange or pour stop (52*a*) attached to a load bearing structural I-beam (52*b*) and vertical building component (54) comprises a stud (54*a*) coupled to an exterior wall member (54*b*). Exterior wall member (54*b*) may comprise any suitable material, including but not limited to gypsum sheathing, plywood, metal building panels, and metal lath. In some embodiments, stud (54*a*) may comprise a curtain-wall stud and exterior wall member (54*b*) may comprise a curtain-wall or portion thereof. Angle flange (52*a*) may be configured to retain a flooring material, such as concrete, that can be used to create a floor/ceiling in building structure (150). By way of example only, angle flange (52*a*) may be used in conjunction with a fluted deck.

In the illustrated embodiment, first plate (120) is attached to horizontal building component (52). Specifically, first plate (120) is attached to an outer face of the vertical leg of angled flange (52*a*). In some embodiments, first plate (120) can be attached to other suitable portions of horizontal building component (52), including the vertical web of I-beam (52*b*). In some embodiments, clip (110) can be positioned such that the exterior face (123) of first plate (120) is in contact with a surface of horizontal building component (52), such as the outer face of the vertical leg of angled flange (52*a*) or the outer face of the vertical web of I-beam (52*b*). First plate (120) is fixedly attached to horizontal building component (52) such that horizontal building component (52) cannot slidably move in a horizontal direction (i.e., in the direction of axis (A1)) relative to clip (110) and vertical building component (54). First plate (120) can be attached to horizontal building component (52) using one or more conventional fasteners (53), such as standard screws or any other fasteners suitable to fixedly attach first plate (120) to horizontal building component (52) as would be apparent to one skilled in the art in view of the teachings herein. Any suitable number of fasteners (53) may be used and fasteners (53) may be installed utilizing one or more of fastener indicia (122) on first plate (120).

In the illustrated embodiment, second plate (130) is attached to vertical building component (54), which includes stud (54*a*). Specifically, second plate (130) is attached to an outer surface of the web of stud (54*a*). In some embodiments, clip (110) can be positioned such that exterior surface (133) of second plate (130) is in contact with a surface of vertical building component (54), such as the outer surface of the web of stud (54*a*). Second plate (130) is attached to vertical building component (54) such that vertical building component (54) can slidably move in a vertical direction (i.e., the direction of axis (A3)) relative to clip (110) and horizontal building component (52) even after clip (110) is installed in building structure (150). Similar to second plate (30) discussed above, second plate (130) can also be attached to vertical building component (54) using one or more conventional fasteners (53) through respective slots (132, 134), such as shoulder screws, standard screws with stepped bushings, or any other fasteners configured to cooperate with clip (110) to allow vertical building component (54) to slidably move vertically (i.e., in the direction of axis (A3)) relative to clip (110) and horizontal building component (52). Any suitable number of fasteners (53) may be used and fasteners (53) may be installed in one or more of slots (132, 134) on second plate (130). For example, in some embodiments a single fastener (53) may be installed in one or more of slots (132, 134), while in other embodiments two or more fasteners (53) may be installed in one or more of slots (132, 134). The number of fasteners (53) installed in each of slots (132, 134) may be the same in some embodiments, while the number of fasteners (53) installed in two or more of slots (132, 134) may vary in other embodiments. Additionally, in some embodiments, at least one fastener (53) is installed through each slot (132, 134), while in other embodiments, one or more of slots (132, 134) may not have any fasteners (53) installed therein.

Furthermore, in some embodiments a single fastener (53) may be installed in one or more of coupling slots (134), while in other embodiments two or more fasteners (53) may be installed in one or more of coupling slots (134). Similarly, in some embodiments a single fastener (53) may be installed in one or more of deflection slots (132), while in other embodiments two or more fasteners (53) may be installed in one or more of deflection slots (132). In addition, the number of fasteners (53) installed in each of coupling slots (134) may be the same in some embodiments, while the number of fasteners (53) installed in each of coupling slots (134) may vary in other embodiments. Similarly, the number of fasteners (53) installed in each of deflection slots (132) may be the same in some embodiments, while the number of fasteners (53) installed in two or more of deflection slots (132) may vary in other embodiments. Additionally, in some embodiments, at least one fastener (53) is installed through each coupling slot (134), while in other embodiments, one or more of coupling slots (134) may not have any fasteners (53) installed therein. As discussed in more detail above with regard to FIGS. 4A and 4B, having at least one fastener (53) installed in each coupling slot (134) may allow clip (110) to withstand larger loads compared to embodiments where at least one coupling slot (134) does not have any fasteners (53) installed therein. In some embodiments, at least one fastener (53) is installed through each deflection slot (132), while in other embodiments, one or more of deflection slots (132) may not have any fasteners (53) installed therein. In some embodiments, a single fastener may be installed in each slot (132, 134) aligned with the central measurement indicia (135) adjacent the respective slot (132, 134). Increasing the number of fasteners (53) installed in one or more slots (132, 134) may increase the load clip (110) is capable of withstanding.

In some applications where it is not desirable to allow vertical building component (54) to slidably move in a vertical direction relative to clip (110) and horizontal building component (52), fasteners (53) may be installed through fastener guides (140). Installation of fasteners (53) through fastener guides (140) fixedly attaches second plate (130) to a surface of vertical building component (54), such as the web of stud (54*a*). In such embodiments, fasteners (53) may be installed through fastener guides (140) in addition to or in lieu of fasteners (53) being installed in one or more of slots (132, 134).

As mentioned above, some external loads experienced on an exterior wall member (54*b*) may be transmitted to the stud (54*a*), the clip (110), and the horizontal building component (52). One such load may be a "lateral in-plane load" (F) as shown in FIGS. 4A-4B and described above.

As also mentioned above, clip (110) acts as a structural support for stud (54*a*) and exterior wall member (54*b*) such that lateral in-plane loads (F) acting on vertical building member (54) or components thereof (e.g., exterior wall member (54*b*)) may be transmitted to horizontal building component (52) via clip (110). Similar to second plate (30) described above, because second plate (130) is coupled to stud (54*a*), lateral in-plane loads (F) may be transferred from exterior wall member (54*b*) to stud (54*a*) via the connection point(s) between exterior wall member (54*b*) and stud (54*a*), and from stud (54*a*) to second plate (130) via fasteners (53) securing second plate (30) to stud (54*a*). Additionally, similar to second plate (30) described above, because second plate (130) extends away from horizontal building component (52) at juncture (112), this lateral in-plane load (F) may generate a torque and increasing bending moment within second plate (130), causing second plate (30) to either "fold" (i.e. deform either elastically or plastically) toward or away first plate (120), depending on the direction of the lateral in-plane load (F). Such folding of plates (120, 130) may be substantially about axis (A3) defined by juncture (112) such that plates (120, 130) "pivot" or otherwise deform near about axis (A3) toward or away from each other while experiencing a lateral in-plane load (F).

Similar to second plate (30) described above, because the load (F) is offset from second plate (130), the resulting torque and bending moment located closer to juncture (112) may be greater than the resulting torque and bending moment located at the free end of second plate (130). As mentioned above, and as will also be described in greater detail below, second plate (130) includes enhanced coupling features configured to maintain suitable securement between second plate (130) and its corresponding building component while accommodating for lateral in-plane loads (F) to be transmitted through second plate (130) during exemplary use.

In particular, in the illustrated embodiment, second plate (130) includes coupling slots (134), each configured to receive at least one faster (53). Since coupling slots (134) are aligned in accordance with the description above (i.e. offset from juncture (112) substantially the same distance (d1'), which is closer to juncture (112) than other distances (d2', d3') of deflection slots (132)), each fastener (53) within its respective slot (134) may share the resulting load/moment generated from the lateral in-plane load (F). This sharing of the resulting load/moment between fasteners (53) within aligned slots (134) may allow second plate (130) to maintain suitable securement with stud (54*a*) while experiencing a lateral in-plane load (F) that generates a greater bending moment near juncture (112) compared to the bending moment at the free end of second plate (130).

As mentioned above, coupling slots (134) are located closest to juncture (112) as compared to deflection slots (132). Therefore, deflection slots (132) are generally located along a portion of second plate (130) that may experience a lesser bending moment/torque from a lateral in-plane load (F) as compared to the portion of second plate (130) where coupling slots (134) are located as described above. As a result, deflection slots (132) may only require one fastener (53) to maintain suitable securement between second plate (130) and stud (54*a*) while experiencing a lateral in-plane load (F) that generates a bending moment that gradually increases along the length of second plate (130) from the free edge thereof toward juncture (112).

In addition, as discussed above with regard to clip (10), the use of multiple individual coupling slots (134) with a fastener (53) in each of the coupling slots (134) may provide several benefits compared to clips with a single coupling slot with one or more fasteners in the single coupling slot, even in clips where the single coupling slot has a length that is substantially equal to or greater than the length from the uppermost edge (134*a*) of the upper coupling slot (134) to the lowermost edge (134*b*) of the lower coupling slot (134) in the illustrated embodiments. For example, embodiments with multiple individual coupling slots (134), such as those illustrated herein, may be able to withstand a higher load than a clip with a single coupling slot and multiple fasteners therein. Additionally, embodiments with multiple individual coupling slots (134) may also facilitate installation by providing automatic or predefined spacing between fasteners (53) installed in coupling slots (134). Having proper spacing between fasteners (53) in coupling slots (134) may improve the load capacity of the clip (110) while also ensuring the clip (110) can provide the desired amount of deflection. Clips with a single coupling slot of greater length provide a greater opportunity for users to install fasteners incorrectly within the coupling slot (e.g., too close together, too far apart, not aligned within the slot correctly to provide the desired deflection, etc.). For example, installing fasteners at the midpoint of each coupling slot (134) may provide the largest amount of deflection in both directions, whereas achieving the largest amount of deflection in both directions by installing two fasteners in a single slot would require locating each fastener at a specific location within the slot relative to both the ends of the slot and the other fastener. Neither of those locations would be the midpoint of the single slot, and, thus, may be more difficult to locate.

Figure 8:
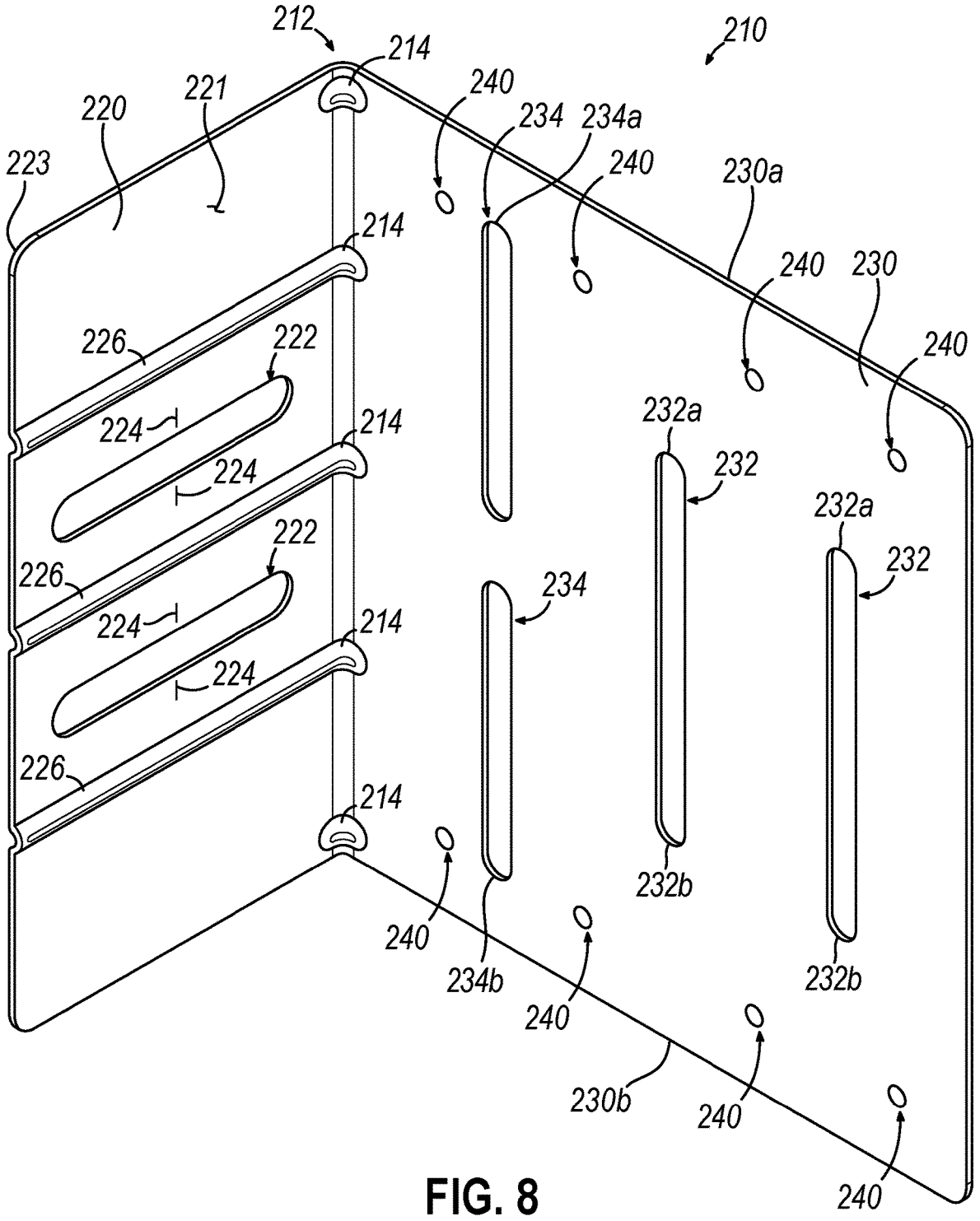
FIG. 8 depicts a perspective view of a third exemplary slide clip.

III. Exemplary Alternative Slide Clips Allowing Vertical and Horizontal Movement FIG. 8 shows an exemplary slide clip (210) that may be used as a replacement for slide clip (10) described above. Slide clip (210) may be substantially similar to slide clip (10) described above, with differences elaborated below. Specifically, slide clip (210) includes a first plate (220), a second plate (230), a juncture (212), and stiffener darts (214), which may be substantially similar to first plate (20), second plate (30), juncture (12), and stiffener darts (14) described above, respectively, with differences elaborated below.

As shown, first plate (220) includes a pair of elongated drift slots (222), an interior surface (221), a rear surface (223), measurement indicia (224), and stiffening ribs (226), which may be substantially similar to elongated drive slots (22), interior surface (21), rear surface (23), measurement indicia (24), and stiffening ribs (26) described above, respectively, with differences elaborated below.

Unlike second plate (30) described above, second plate (230) does not have any raised channels (36) defining stiffener regions (38). Additionally, second plate (230) does not have any measurement indicia (35). However, in other embodiments, second plate (230) may have one or more of raised channels (26), stiffener regions (38) and measurement indicia (35) if desirable. Additionally, unlike second plate (30) described above, second plate (230) includes fastener guides (240) that may be used to fixedly attached second plate (230) to an underlying building component in similar fashion to fastener guides (140) described above.

As shown, second plate (230) also includes elongated deflection slots (232) and a pair of aligned coupling slots (234), which may be substantially similar to elongated deflection slots (32) and aligned coupling slots (34) described above, with differences elaborated below. Coupling slots (234) may provide the same benefits as coupling slots (34) described above.

Similar to clip (10) described above, in the embodiment shown in FIG. 8, deflection slots (232) and coupling slots (234) are arranged such that the midpoint of upper coupling slot (234) is above the respective midpoints of deflection slots (232) and the midpoint of lower coupling slot (234) is below the respective midpoints of deflection slots (232). In other words, the midpoint of upper coupling slot (234) is closer to upper edge (230*a*) of second plate (230) than the respective midpoints of deflection slots (232) and the midpoint of lower coupling slot (234) is closer to lower edge (230*b*) of second plate (230) than the respective midpoints of deflection slots (232). However, unlike clip (10) described above, in this embodiment, uppermost edge (234*a*) of the upper coupling slot (234) is closer to the upper edge (230*a*) of second plate (230) than the uppermost edges (232*a*) of deflection slots (232), while lowermost edge (234*b*) of the lower coupling slot (234) is closer to the lower edge (230*b*) of second plate (230) than the lowermost edges (232*b*) of deflection slots (232). In some embodiments, slots (232, 234) may be arranged such that their respective uppermost and lowermost edges (232*a*, 232*b*, 234*a*, 234*b*) are at least about 0.5 inches from the nearest edge (230*a*, 230*b*) of second plate (230).

Figure 9:
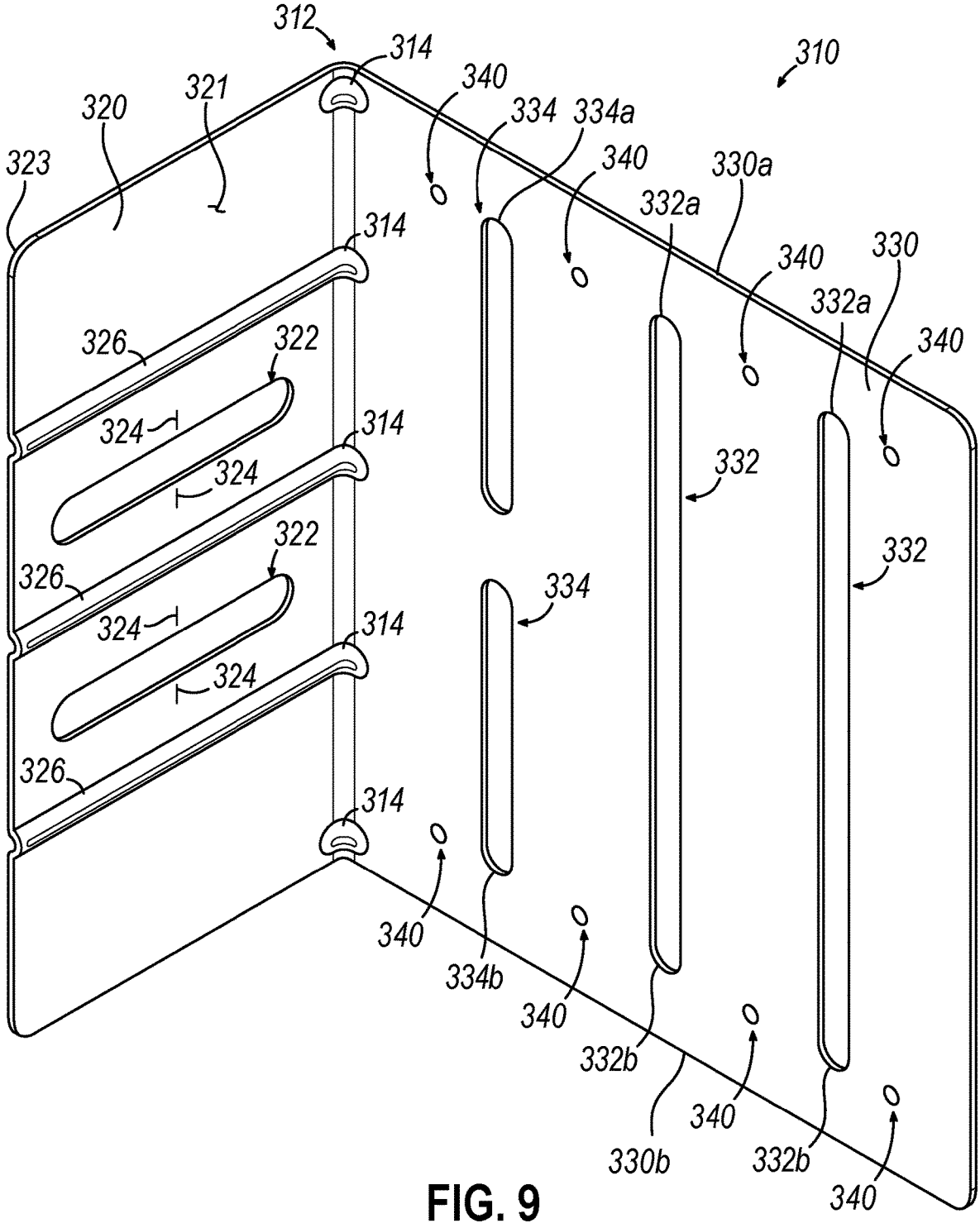
FIG. 9 depicts a perspective view of a fourth exemplary slide clip.

FIG. 9 shows another exemplary slide clip (310) that may be used as a replacement for slide clip (10) described above. Slide clip (310) may be substantially similar to slide clip (10) described above, with differences elaborated below. Specifically, slide clip (310) includes a first plate (320), a second plate (330), a juncture (312), and stiffener darts (314), which may be substantially similar to first plate (20), second plate (30), juncture (12), and stiffener darts (14) described above, respectively, with differences elaborated below.

As shown, first plate (320) includes a pair of elongated drift slots (322), an interior surface (321), a rear surface (323), measurement indicia (324), and stiffening ribs (326), which may be substantially similar to elongated drift slots (22), interior surface (21), rear surface (23), measurement indicia (24), and stiffening ribs (26) described above, respectively, with differences elaborated below.

Unlike second plate (30) described above, second plate (330) does not have any raised channels (36) defining stiffener regions (38). Additionally, second plate (330) does not have any measurement indicia (35). However, in other embodiments, second plate (330) may have one or more of raised channels (26), stiffener regions (38), and measurement indicia (35) if desirable. Additionally, unlike second plate (30) described above, second plate (330) includes faster guides (340) that may be used to fixedly attached second plate (330) to an underlying building component in similar fashion to fastener guides (140) described above.

As shown, second plate (330) also includes elongated deflection slots (332) and a pair of aligned coupling slots (234), which may be substantially similar to elongated deflection slots (32) and aligned coupling slots (34) described above, with differences elaborated below. Coupling slots (334) may provide the same benefits as coupling slots (34) described above.

Similar to clip (10) described above, in the embodiment shown in FIG. 9, deflection slots (332) and coupling slots (334) are arranged such that the midpoint of upper coupling slot (334) is above the respective midpoints of deflection slots (332) and the midpoint of lower coupling slot (334) is below the respective midpoints of deflection slots (332). In other words, the midpoint of upper coupling slot (334) is closer to upper edge (330*a*) of second plate (330) than the respective midpoints of deflection slots (332) and the midpoint of lower coupling slot (334) is closer to lower edge (330*b*) of second plate (330) than the respective midpoints of deflection slots (332). However, unlike clip (10) described above, in this embodiment, uppermost and lowermost edges (332*a*, 332*b*) of deflection slots (332) are substantially the same distance away from the respective upper and lower edges (330*a*, 330*b*) of second plate (330) as uppermost edge (334*a*) of the upper coupling slot (334) and the lowermost edge (334*b*) of the lower coupling slot (334). In some embodiments, slots (332, 334) may be arranged such that their respective uppermost and lowermost edges (332*a*, 332*b*, 334*a*, 334*b*) are at least about 0.5 inches from the nearest edge (330*a*, 330*b*) of second plate (330).

IV. Exemplary Alternative Slide Clips Allowing Vertical Movement

Figure 10:
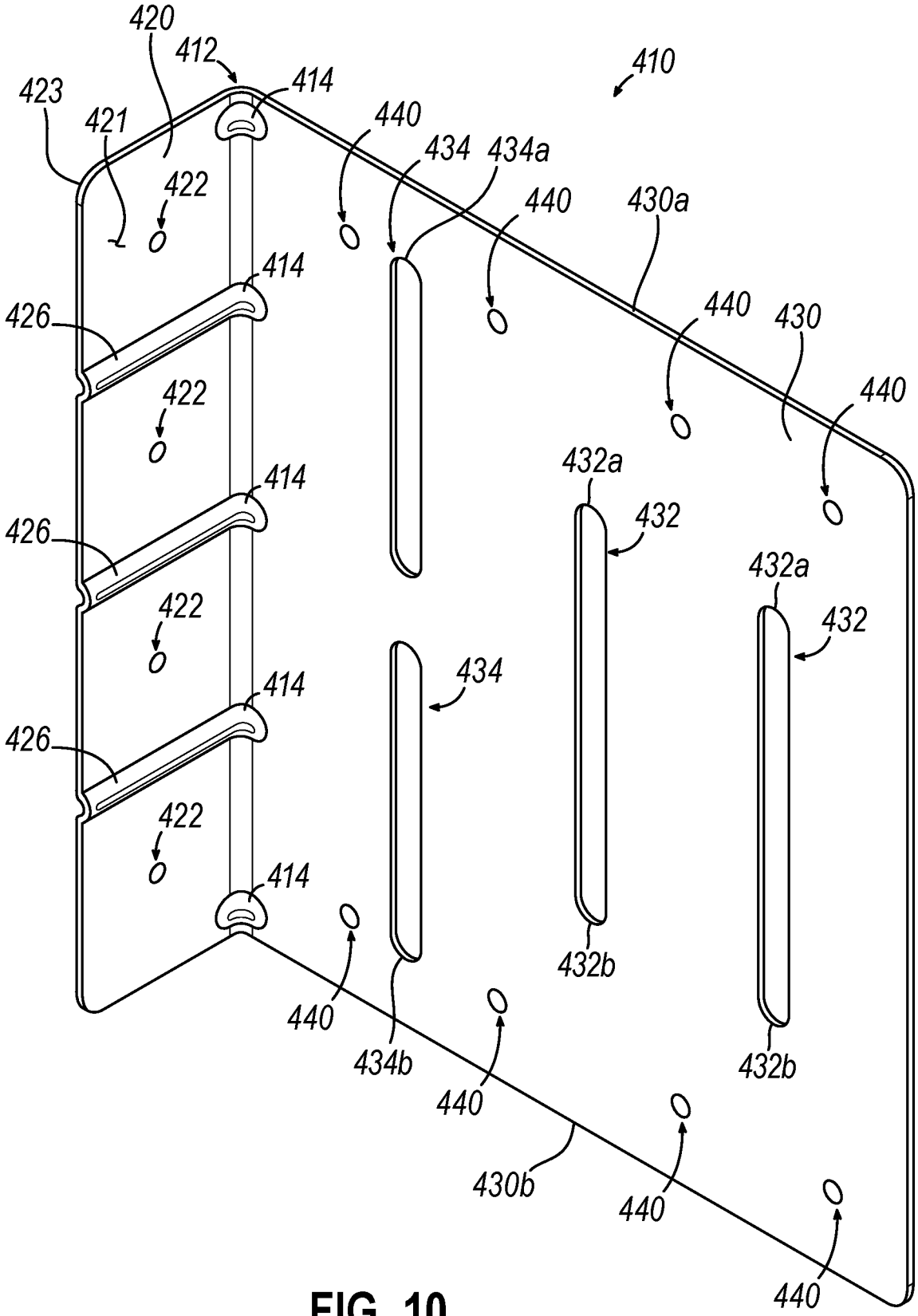
FIG. 10 depicts a perspective view of a fifth exemplary slide clip.

FIG. 10 shows an exemplary slide clip (410) that may be used as a replacement for slide clip (110) described above. Slide clip (410) may be substantially similar to slide clip (110) described above, with differences elaborated below. Specifically, slide clip (410) includes a first plate (420), a second plate (430), a juncture (412), and stiffener darts (414), which are substantially similar to first plate (120), second plate (130), juncture (112), and stiffener darts (114) described above, respectively, with differences elaborated below.

As shown, first plate (420) includes an interior surface (421), a rear surface (423), fastener indicia (422), and stiffener ribs (426), which may be substantially similar to interior surface (121), rear surface (123), fastener indicia (122), and stiffener ribs (126) described above, respectively, with differences elaborated below.

Unlike second plate (130) described above, second plate (430) does not have any raised channels (136) defining stiffener regions (138). Additionally, second plate (430) does not have any measurement indicia (135). However, in some embodiments, second plate (430) may have one or more of raised channels (126), stiffener regions (138), and measurement indicia (135) if desirable. Additionally, second plate (430) includes fastener guides (440) that may be used to fixedly attached second plate (430) to an underlying building component in similar fashion to fastener guides (140) described above.

As shown, second plate (430) also includes elongated deflection slots (432) and a pair of aligned coupling slots (434), which may be substantially similar to elongated deflection slots (132) and aligned coupling slots (134)

described above, with differences elaborated below. Coupling slots (434) may provide the same benefits as coupling slots (134) described above.

Similar to clip (110) described above, in the embodiment shown in FIG. 10, deflection slots (432) and coupling slots (434) are arranged such that the midpoint of upper coupling slot (434) is above the respective midpoints of deflection slots (432) and the midpoint of lower coupling slot (434) is below the respective midpoints of deflection slots (432). In other words, the midpoint of upper coupling slot (434) is closer to upper edge (430*a*) of second plate (430) than the respective midpoints of deflection slots (432) and the midpoint of lower coupling slot (434) is closer to lower edge (430*b*) of second plate (430) than the respective midpoints of deflection slots (432). However, unlike clip (110) described above, in this embodiment, uppermost edge (434*a*) of the upper coupling slot (434) is closer to the upper edge (430*a*) of second plate (430) than the uppermost edges (432*a*) of deflection slots (432); while lowermost edge (434*b*) of the lower coupling slot (434) is closer to the lower edge (430*b*) of second plate (430) than the lowermost edges (432*b*) of deflection slots (432). In some embodiments, slots (432, 434) may be arranged such that their respective uppermost and lowermost edges (432*a*, 432*b*, 434*a*, 434*b*) are at least about 0.5 inches from the nearest edge (430*a*, 430*b*) of second plate (430).

Figure 11:
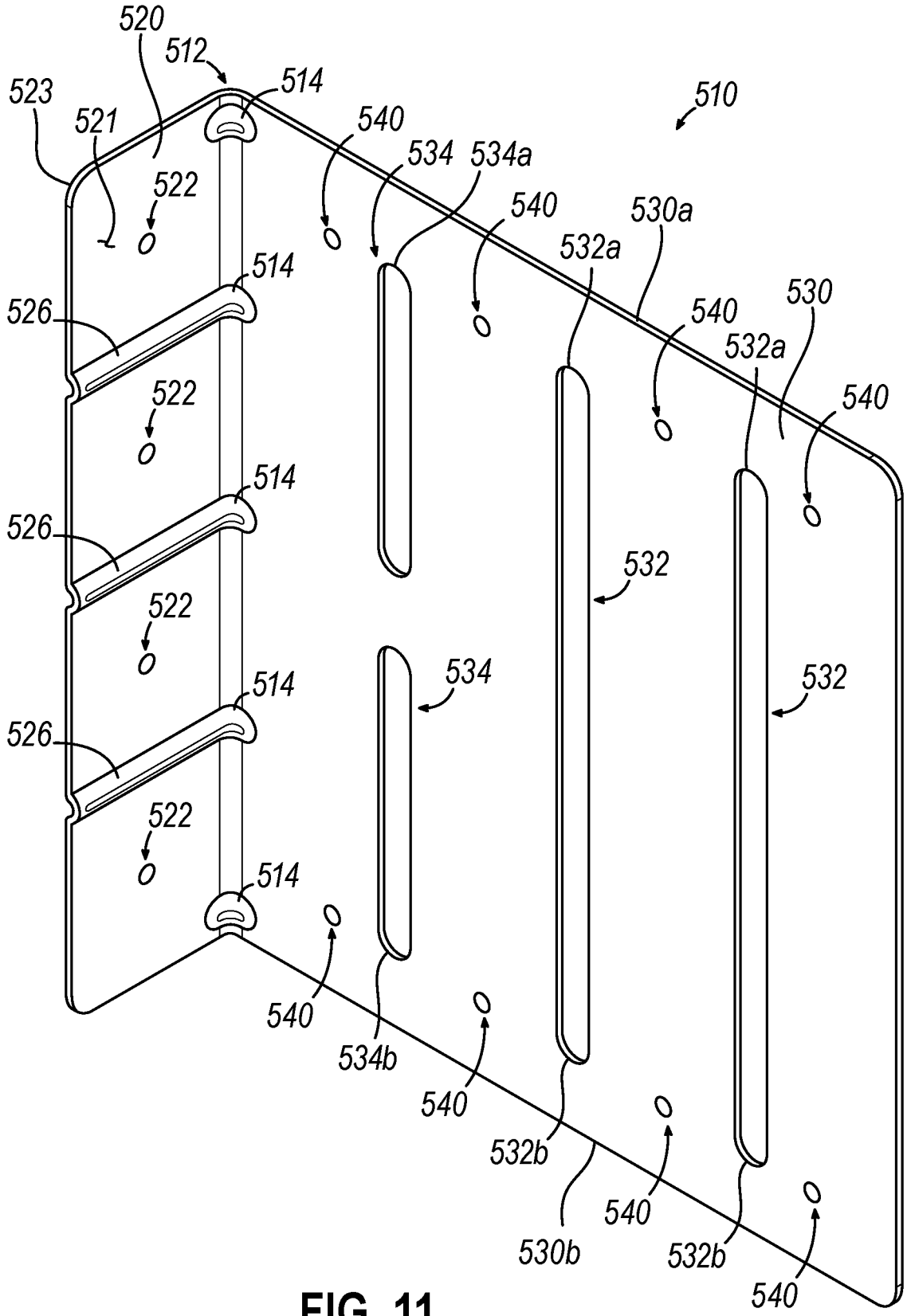
FIG. 11 depicts a perspective view of a sixth exemplary slide clip.

FIG. 11 shows an exemplary slide clip (510) that may be used as a replacement for slide clip (110) described above. Slide clip (510) may be substantially similar to slide clip (110) described above, with differences elaborated below. Specifically, slide clip (510) includes a first plate (520), a second plate (530), a juncture (512), and stiffener darts (514), which are substantially similar to first place (120), second plate (130), juncture (112), and stiffener darts (114) described above, respectively, with differences elaborated below.

As shown, first plate (520) includes an interior surface (521), a rear surface (523), fastener indicia (522), and stiffener ribs (526), which may be substantially similar to interior surface (121), rear surface (123), fastener indicia (122), and stiffener ribs (126) described above, respectively, with differences elaborated below.

Unlike second plate (130) described above, second plate (530) does not have any raised channels (136) defining stiffener regions (138). Additionally, second plate (530) does not have any measurement indicia (135). However, in other embodiments, second plate (530) may have one or more of raised channels (126), stiffener regions (138), and measurement indicia (135) if desirable. Additionally, second plate (530) includes faster guides (540) that may be used to fixedly attached second plate (530) to an underlying building component in similar fashion to fastener guides (540) described above.

As shown, second plate (530) also includes elongated deflection slots (532) and a pair of aligned coupling slots (534), which may be substantially similar to elongated deflection slots (132) and aligned coupling slots (134) described above, with differences elaborated below. Coupling slots (534) may provide the same benefits as coupling slots (134) described above.

Similar to clip (110) described above, in the embodiment shown in FIG. 11, deflection slots (532) and coupling slots (534) are arranged such that the midpoint of upper coupling slot (534) is above the respective midpoints of deflection slots (532) and the midpoint of lower coupling slot (534) is below the respective midpoints of deflection slots (532). In other words, the midpoint of upper coupling slot (534) is closer to upper edge (530*a*) of second plate (530) than the respective midpoints of deflection slots (532) and the midpoint of lower coupling slot (534) is closer to lower edge (530*b*) of second plate (530) than the respective midpoints of deflection slots (532). However, unlike clip (110) described above, in this embodiment, uppermost and lowermost edges (532*a*, 532*b*) of deflection slots (532) are substantially the same distance away from the respective upper and lower edges (530*a*, 530*b*) of second plate (530) as uppermost edge (534*a*) of the upper coupling slot (534) and the lowermost edge (534*b*) of the lower coupling slot (534). In some embodiments, slots (532, 534) may be arranged such that their respective uppermost and lowermost edges (532*a*, 532*b*, 534*a*, 534*b*) are at least about 0.5 inches from the nearest edge (530*a*, 530*b*) of second plate (530).

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. A slide clip comprising:

(a) a first plate; and (b) a second plate connected to the first plate at a juncture, wherein the second plate extends from the juncture to define an angle with the first plate;

wherein the second plate further comprises:

(i) a first elongated slot comprising a first length and extending along a first longitudinal axis substantially parallel with the juncture, wherein the first elongated slot is offset from the juncture a first distance, (ii) a second elongated slot comprising a second length and extending along a second longitudinal axis substantially parallel with the juncture, wherein the second elongated slot is offset from the juncture the first distance such that the second longitudinal axis and the first longitudinal axis are aligned with each other, and (iii) a third elongated slot comprising a third length and extending along a third longitudinal axis substantially parallel with the juncture, wherein the third elongated slot is offset from the juncture at a second distance, wherein the second distance is greater than the first distance, wherein the first length is substantially equal to the second length, and the third length is greater than the first length and the second length.

2. The slide clip of claim 1, wherein the second plate further comprises a fourth elongated slot extending along a fourth longitudinal axis substantially parallel with the juncture, wherein the fourth elongated slot is offset from the juncture at a third distance, wherein the third distance is greater than the second distance.

3. The slide clip of claim 1, further comprising a plurality of stiffening darts positioned within the juncture.

4. The slide clip of claim 1, wherein the first plate further comprises a plurality of stiffening ribs, wherein at least one of the plurality of stiffening ribs extends along a longitudinal axis that is perpendicular to the juncture.

5. The slide clip of claim 1, wherein the first plate further comprises at least one elongated slot extending along a longitudinal axis that is perpendicular to the juncture.

6. The slide clip of claim 1, wherein the angle is about 90 degrees.

7. The slide clip of claim 1, wherein the second plate further comprises a first fastener guide positioned above the third elongated slot.

8. The slide clip of claim 1, wherein the second plate further comprises a first fastener guide positioned laterally between the first slot and the third slot.

9. The slide clip of claim 8, wherein the first fastener guide is selected from the group consisting of a through hole and a dimple.

10. The slide clip of claim 1, wherein the second plate further comprises a stiffener region.

11. The slide clip of claim 10, wherein the stiffener region comprises a raised channel.

12. The slide clip of claim 11, wherein the raised channel surrounds the first slot, the second slot, and the third slot.

13. A slide clip comprising:

(a) a first plate; and (b) a second plate comprising an upper edge and a lower edge, wherein the second plate is connected to the first plate at a juncture, wherein the second plate extends from the juncture to define an angle with the first plate;

wherein the second plate further comprises:

(i) a first elongated slot comprising a first midpoint and extending along a first longitudinal axis substantially parallel with the juncture, wherein the first elongated slot is offset from the juncture a first distance, (ii) a second elongated slot comprising a second midpoint and extending along a second longitudinal axis substantially parallel with the juncture, wherein the second elongated slot is offset from the juncture the first distance such that the second longitudinal axis and the first longitudinal axis are aligned with each other, and (iii) a third elongated slot comprising a third midpoint and extending along a third longitudinal axis substantially parallel with the juncture, wherein the third elongated slot is offset from the juncture at a second distance, wherein the second distance is greater than the first distance, wherein the first midpoint of the first slot is closer to the upper edge of the second plate than the third midpoint of the third slot, and wherein the second midpoint of the second slot is closer to the lower edge of the second plate than the third midpoint of the third slot, wherein the third elongated slot is longer than the first elongated slot.

14. The slide clip of claim 13, wherein the first plate comprises an elongated slot that extends along a longitudinal axis that is perpendicular to the juncture.

15. A building structure comprising:

(a) a first building component;

(b) a second building component;

(c) a slide clip connecting the first building component to the second building component, wherein the slide clip comprises (i) a first plate, and (ii) a second plate comprising an upper edge and a lower edge, wherein the second plate is connected to the first plate at a juncture, wherein the second plate extends from the juncture to define an angle with the first plate, wherein the second plate further comprises:

1) a first elongated slot comprising a first midpoint and extending along a first longitudinal axis substantially parallel with the juncture, wherein the first elongated slot is offset from the juncture a first distance, 2) a second elongated slot comprising a second midpoint and extending along a second longitudinal axis substantially parallel with the juncture, wherein the second elongated slot is offset from the juncture the first distance such that the second longitudinal axis and the first longitudinal axis are aligned with each other, and 3) a third elongated slot comprising a third midpoint and extending along a third longitudinal axis substantially parallel with the juncture, wherein the third elongated slot is offset from the juncture at a second distance, wherein the second distance is greater than the first distance, wherein the first midpoint of the first slot is closer to the upper edge of the second plate than the third midpoint of the third slot, and wherein the second midpoint of the second slot is closer to the lower edge of the second plate than the third midpoint of the third slot, wherein the third elongated slot is longer than the first elongated slot, (d) a first fastener installed in the first elongated slot that slidably connects the second plate to the second building component; and (e) a second fastener installed in the second elongated slot that slidably connects the second plate to the second building component.

16. The building structure of claim 15, wherein the first elongated slot further comprises a first uppermost edge, the second elongated slot further comprises a second lowermost edge, and the third elongated slot further comprises a third uppermost edge and a third lowermost edge, wherein the first uppermost edge and the third uppermost edge are offset a substantially equal distance from the upper edge of the second plate, and the second lowermost edge and the third lowermost edge are offset a substantially equal distance from the lower edge of the second plate.

17. The building structure of claim 15, wherein the first elongated slot further comprises a first uppermost edge, the second elongated slot further comprises a second lowermost edge, and the third elongated slot further comprises a third uppermost edge and a third lowermost edge, wherein the first uppermost edge is closer to the upper edge of the second plate than the third uppermost edge, and the second lowermost edge is closer to the lower edge of the second plate than the third lowermost edge.

18. The building structure of claim 15, wherein the first elongated slot further comprises a first uppermost edge, the second elongated slot further comprises a second lowermost edge, and the third elongated slot further comprises a third uppermost edge and a third lowermost edge, wherein the third uppermost edge is closer to the upper edge of the second plate than the first uppermost edge, and the third lowermost edge is closer to the lower edge of the second plate than the second lowermost edge.

* * * * *